US012263986B2

(12) United States Patent
Elvin-Jensen

(10) Patent No.: US 12,263,986 B2
(45) Date of Patent: Apr. 1, 2025

(54) FOLDABLE CONTAINER

(71) Applicant: Rollerplast Systems Inc., Delta (CA)

(72) Inventor: Justin Elvin-Jensen, West Vancouver (CA)

(73) Assignee: ROLLERPLAST SYSTEMS INC., Delta (CA)

( * ) Notice: Subject to any disclaimer, the term of this patent is extended or adjusted under 35 U.S.C. 154(b) by 20 days.

(21) Appl. No.: 18/454,605

(22) Filed: Aug. 23, 2023

(65) Prior Publication Data

US 2024/0067394 A1 Feb. 29, 2024

Related U.S. Application Data

(60) Provisional application No. 63/400,343, filed on Aug. 23, 2022.

(51) Int. Cl.

| | |
|---|---|
| ***B65D 6/18*** | (2006.01) |
| ***B65D 21/02*** | (2006.01) |
| ***B65D 43/02*** | (2006.01) |
| ***B65D 55/14*** | (2006.01) |

(52) U.S. Cl.

CPC ..... *B65D 11/1833* (2013.01); *B65D 21/0222* (2013.01); *B65D 43/0202* (2013.01); *B65D 55/14* (2013.01); *B65D 2255/00* (2013.01)

(58) Field of Classification Search

CPC . B65D 11/1866; B65D 11/1833; B65D 11/18; B65D 21/0222; B65D 21/0217; B65D 45/22; B65D 45/16; B65D 55/14; B65D 2255/00

USPC ..... 220/4.28, 6, 7, 281, 284, 755, 752, 210, 220/326, 324; 206/508; D9/432, 430

See application file for complete search history.

(56) References Cited

U.S. PATENT DOCUMENTS

| | | | | |
|---|---|---|---|---|
| 420,260 | A * | 1/1890 | Yoakum | B65D 7/26 220/531 |
| 712,992 | A * | 11/1902 | Bird | B65D 7/26 292/96 |
| 4,523,692 | A * | 6/1985 | Lemkin | B65D 55/14 206/508 |
| 6,015,056 | A * | 1/2000 | Overholt | B65D 11/1833 220/6 |
| 2011/0220643 | A1* | 9/2011 | Van Der Korput | B65D 19/06 220/6 |
| 2017/0320656 | A1* | 11/2017 | Oskarsson | B65D 25/54 |
| 2022/0289426 | A1* | 9/2022 | Green | B65D 11/18 |

* cited by examiner

*Primary Examiner* — Robert J Hicks

(74) *Attorney, Agent, or Firm* — OYEN, WIGGS, GREEN & MUTALA LLP

(57) ABSTRACT

A foldable container includes a base, a pair of first walls, a pair of second walls, and a lid. The first and second walls may hingedly rotate with respect to the base between an upright and a collapsed position. The lid may attach to the second walls while the second walls are upright. The lid includes latch assemblies, with the latch assemblies including a housing and a button assembly moveable within the housing. The button assembly includes a button body, a latching member, and a spring. The latching member is connected to the button body and may engage with the second wall to attach the lid to the second wall. The spring is connected to the button body and may engage with the housing. Compression of the button body against the spring effects disengagement of the latching member from the second wall to remove the lid from the second wall.

8 Claims, 46 Drawing Sheets

Fig. 11
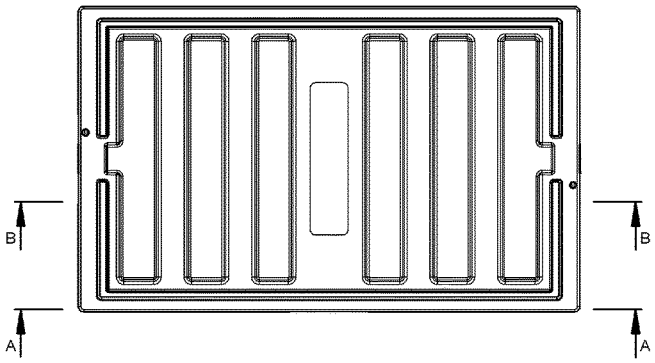
Fig. 14
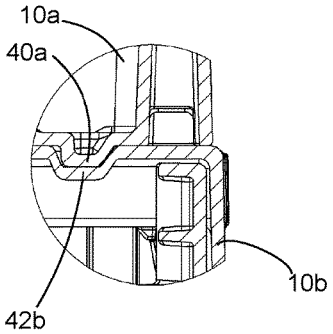
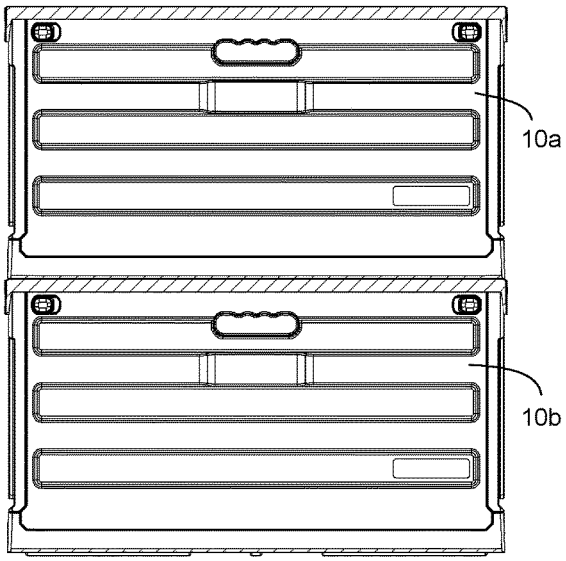
Fig. 12
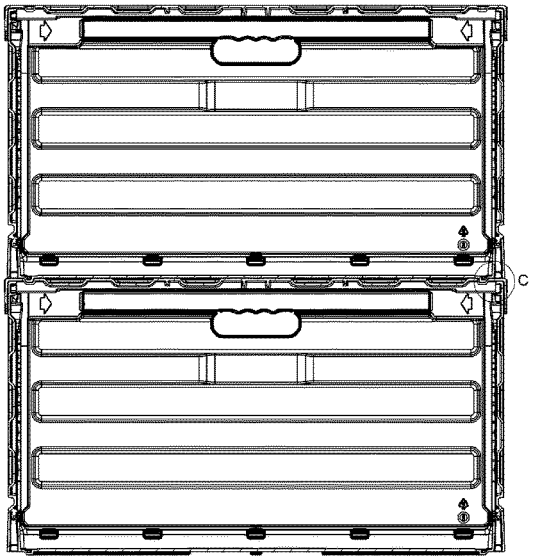
Fig. 13

DETAIL L
SCALE 1 : 2

DETAIL M
SCALE 1 : 2

DETAIL Q
SCALE 1 : 2

DETAIL R
SCALE 1 : 2

SECTION P-P

FOLDABLE CONTAINER

CROSS-REFERENCE TO RELATED APPLICATIONS

This application claims the benefit of U.S. Provisional Patent Application No. 63/400,343 filed Aug. 23, 2022, the contents of which are hereby incorporated by reference.

TECHNICAL FIELD

This disclosure relates to the field of foldable containers, and in particular, foldable containers used for storing or carrying goods.

BACKGROUND

Conventional foldable containers allow the vertical walls of the containers to be folded down to form a substantially flat assembly. This allows the containers to be more efficiently stored when not in use, as multiple (flattened) container assemblies can be placed on top of one another. However, when the containers are in use, the walls must be held securely in place vertically.

Conventional foldable containers typically comprise a base and four wall components. The base and the wall components are typically injection-molded from plastic in one or more molds. The containers, when in their fully upright, assembled configurations, generally form a rectangular box, with two long walls and two short walls. A hinge mechanism connects the bottom edge of each of the walls to the base, and the walls can pivot from an approximately flat orientation (relative to the base) to an upright orientation (relative to the base). In the upright configuration, the walls interlock with each other such that each long wall is interlocked with a short wall on each of its ends and each short wall is interlocked with a long wall at each of its ends.

Because of the folding movement of the walls, it is important that the container be able to maintain sufficient rigidity and strength when in the upright, assembled configuration (i.e. to avoid unintended collapsing of the walls). There is therefore a need for a foldable container that is sufficiently strong and sturdy when assembled, yet takes up less space when folded.

SUMMARY

A foldable container comprises a base with two first walls, two second walls, and a lid. The first and second walls are substantially perpendicular to the base when the container is in its upright configuration. However, hinge mechanisms allow the first and second walls to fold inward and downward to place the container in its collapsed configuration.

Two or more of the containers may be stacked on top of each other. Interacting protrusions and channels on the base and the lid, respectively, help to hold the containers in place when stacked.

One or more of the first and second walls may also be collapsed (while leaving the other ones of the first and second walls upright). Two or more of such containers may be stacked on top of each other to form a shelf unit.

In with one aspect, a foldable container comprises a base, a pair of opposed first walls extending from the base, a pair of opposed second walls extending from the base, and a lid. Each of the second walls comprises a second wall upper edge and a second wall ledge extending inwardly proximate to the second wall upper edge. Each of the first and second walls is configured to hingedly rotate with respect to the base between an upright position and a collapsed position. The lid is configured to removably attach to the second walls while the second walls are in the upright position. The lid comprises one or more latch assemblies, with each of the latch assemblies comprising a housing comprising first and second openings and a button assembly configured to move within the housing. The button assembly comprises a button body, a latching member, and a spring. The latching member is connected to the button body and is configured to pass through the second opening and is further configured to engage with the second wall ledge to attach the lid to the second wall. The spring is connected to the button body and configured to engage with the housing. Compression of the button body against the spring effects disengagement of the latching member from the second wall ledge to remove the lid from the second wall.

In another aspect, the one or more latch assemblies comprises two latch assemblies.

In still another aspect, each of the first walls comprises a first wall upper edge, a first wall ledge extending inwardly proximate to the first wall upper edge, and a first wall member extending inwardly and spaced apart from the first wall ledge.

In yet still another aspect, each of the second walls further comprises a second wall member extending inwardly and spaced apart from the second wall ledge.

In a further aspect, the lid further comprise a lock assembly for locking the lid to the first and second walls while the first and second walls are in the upright position, the lock assembly comprising a central lock configured to accept rotational movement by a key and a plurality of arms. The plurality of arms extends from and is connected to the central lock. The arms are configured to move laterally in between the first wall ledge and the first wall member or in between the second wall ledge and the second wall member to lock the lid to the first and second walls, or to move laterally out from between the first wall ledge and the first wall member or out from between the second wall ledge and the second wall member to unlock the lid to the first and second walls. The central lock is further configured to translate the rotational movement of the key into lateral movement of the arms.

In still a further aspect, the lid further comprises channels, with the arms configured to move, at least in part, within the channels.

In still yet a further aspect, the lid further comprises one or more collars extending across the channels.

In still another aspect, the foldable container further comprises one or more partitions extending between the first walls or between the second walls.

In another aspect, an assembly for attachment to a wall comprises a foldable container and a bracket. The foldable container comprises a base, a pair of opposed first walls extending from the base, a pair of opposed second walls extending from the base, and a lid. The second walls comprise second wall lateral edges and slots proximate to the second wall lateral edges. The slots comprise an angled member. Each of the first and second walls is configured to hingedly rotate with respect to the base between an upright position and a collapsed position. The lid is configured to removably attach to the second walls while the second walls are in the upright position. The bracket is configured to be attached to the wall, with the bracket comprising attachment members. The attachment members comprise an angled surface corresponding in angularity to the angled member, with the attachment members configured to engage with the slots through engagement of the angled surfaces with the angled members to attach the foldable container to the bracket.

In yet another aspect, the bracket comprises one or more fastener openings configured to accept fasteners for attachment of the bracket to the wall.

In still yet another aspect, the bracket comprises one or more upward-extending bracket protrusions.

In a further aspect, the base comprises a base lower edge and a plurality of hollow regions proximate to the base lower edge.

In still a further aspect, the bracket protrusions are configured to engage with the hollow regions to attach the foldable container to the bracket.

The foregoing was intended as a summary only and of only some of the aspects of this disclosure. It was not intended to define the limits or requirements of the invention. Other aspects will be appreciated by reference to the detailed description of the embodiments.

BRIEF DESCRIPTION OF THE DRAWINGS

The preferred embodiments will be described by reference to the drawings thereof, in which:

FIG. 11 is a top view of two containers (in the upright configuration and with the lids attached) stacked on top of each other;

FIG. 12 is a cross-sectional view of FIG. 11 taken along A-A of FIG. 11;

FIG. 13 is a cross-sectional view of FIG. 11 taken along B-B of FIG. 11;

FIG. 14 is a magnified view of the portion C of FIG. 13;

DETAILED DESCRIPTION

Figure 1:
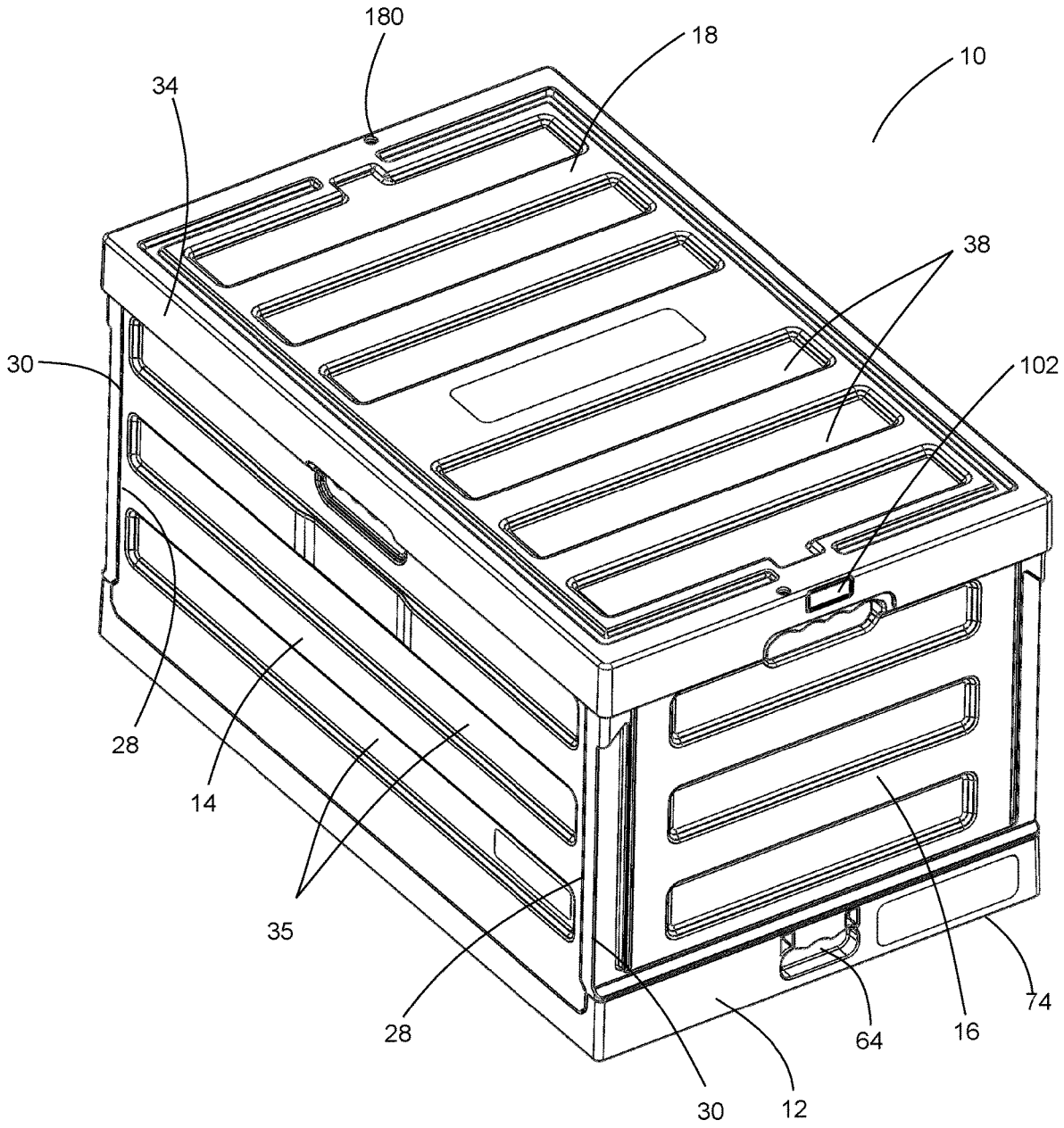
FIG. 1 is a perspective view of a container in accordance with one embodiment, in the upright configuration.
Figure 2:
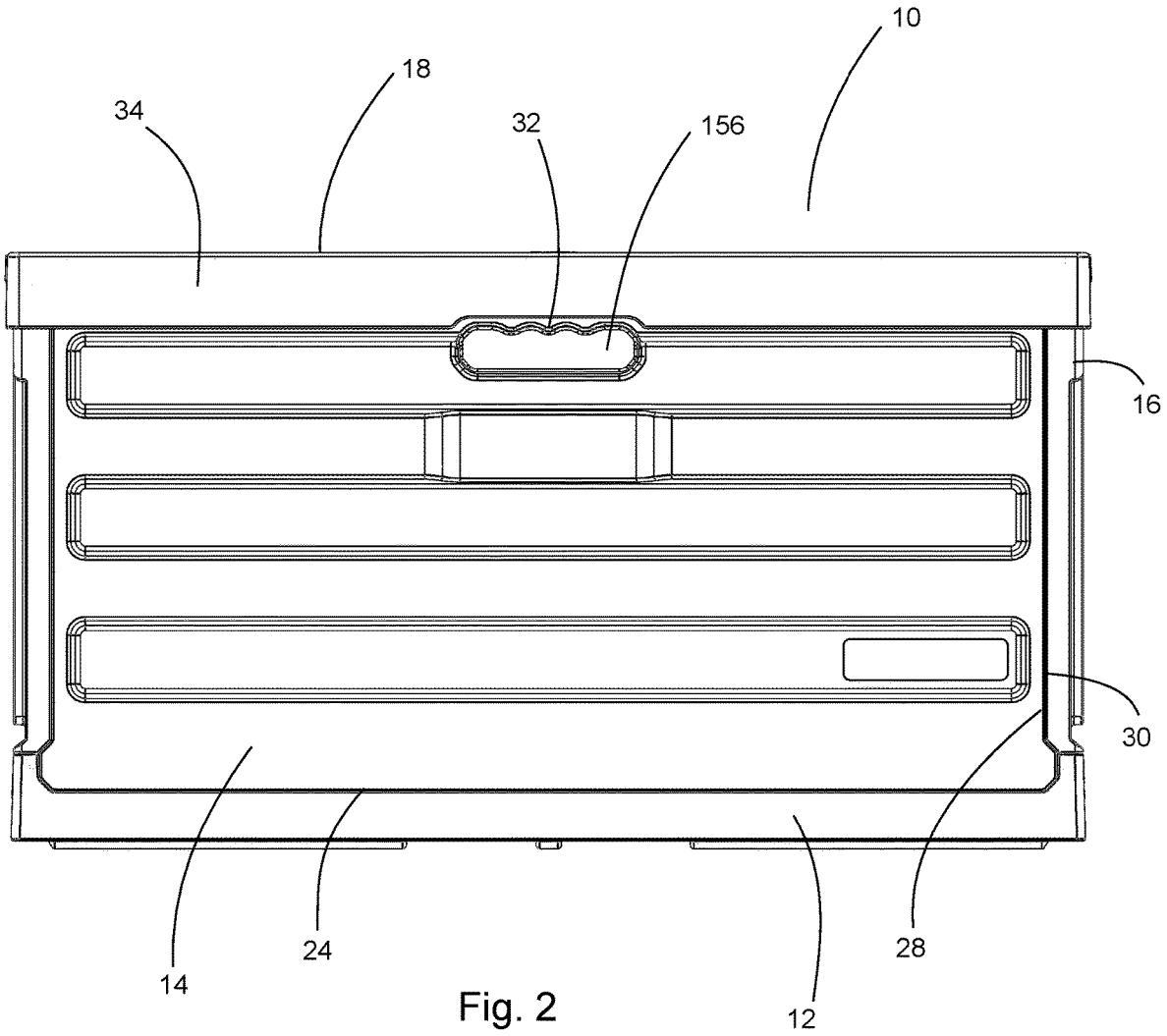
FIG. 2 is a front view of the container of FIG. 1.
Figure 3:
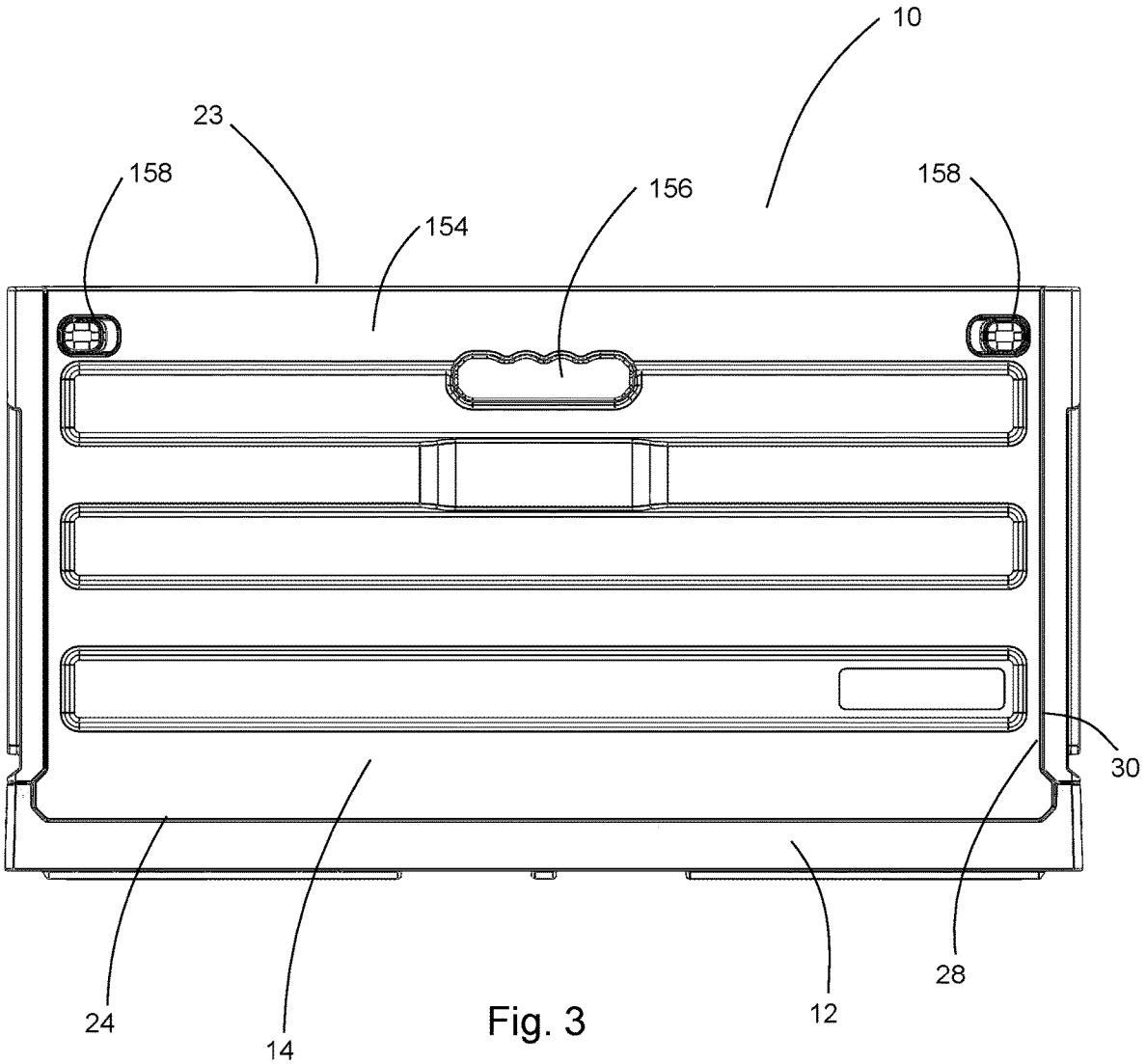
FIG. 3 is a front view of the container of FIG. 1, with the lid removed.
Figure 4:
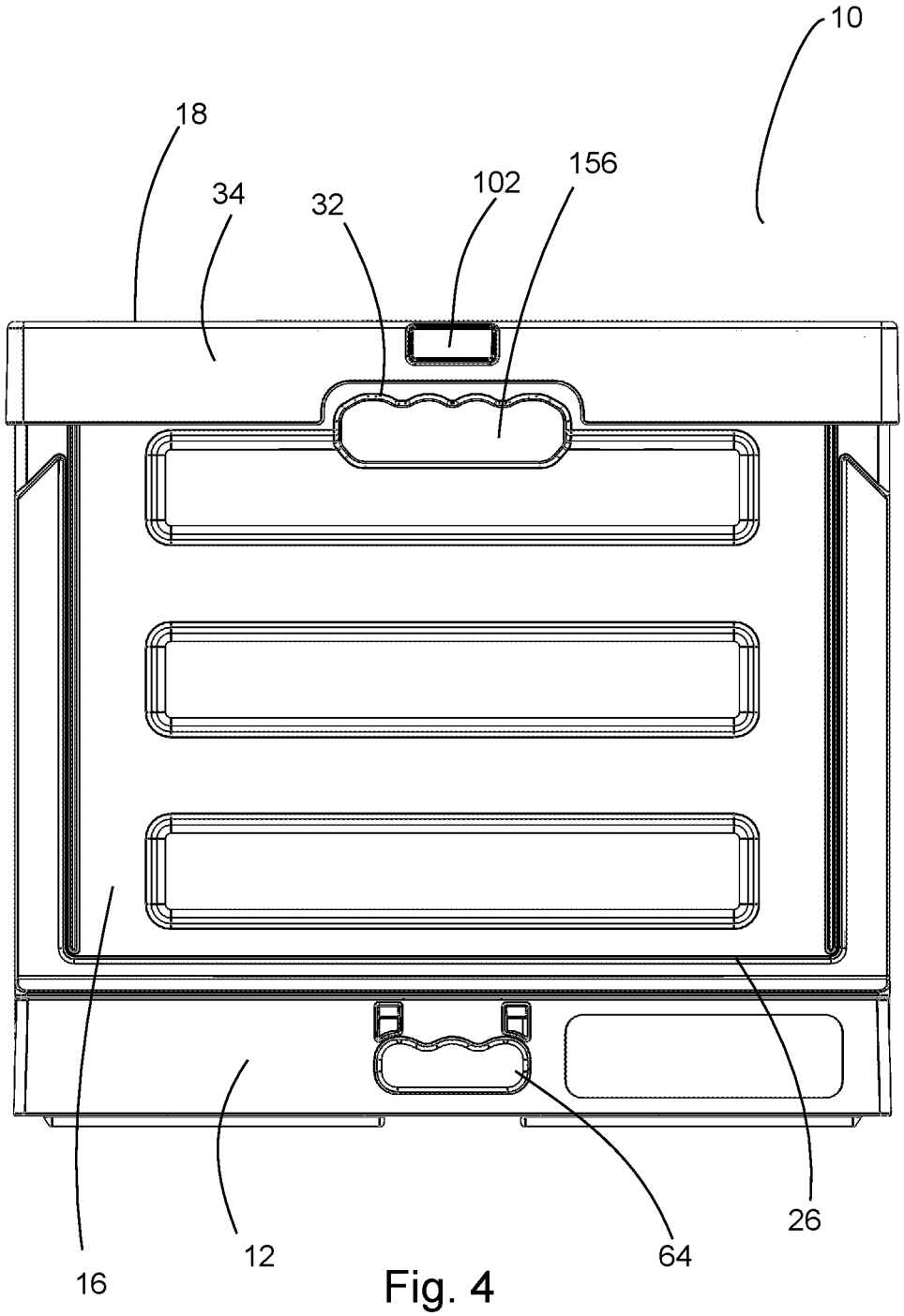
FIG. 4 is a side view of the container of FIG. 1.
Figure 5:
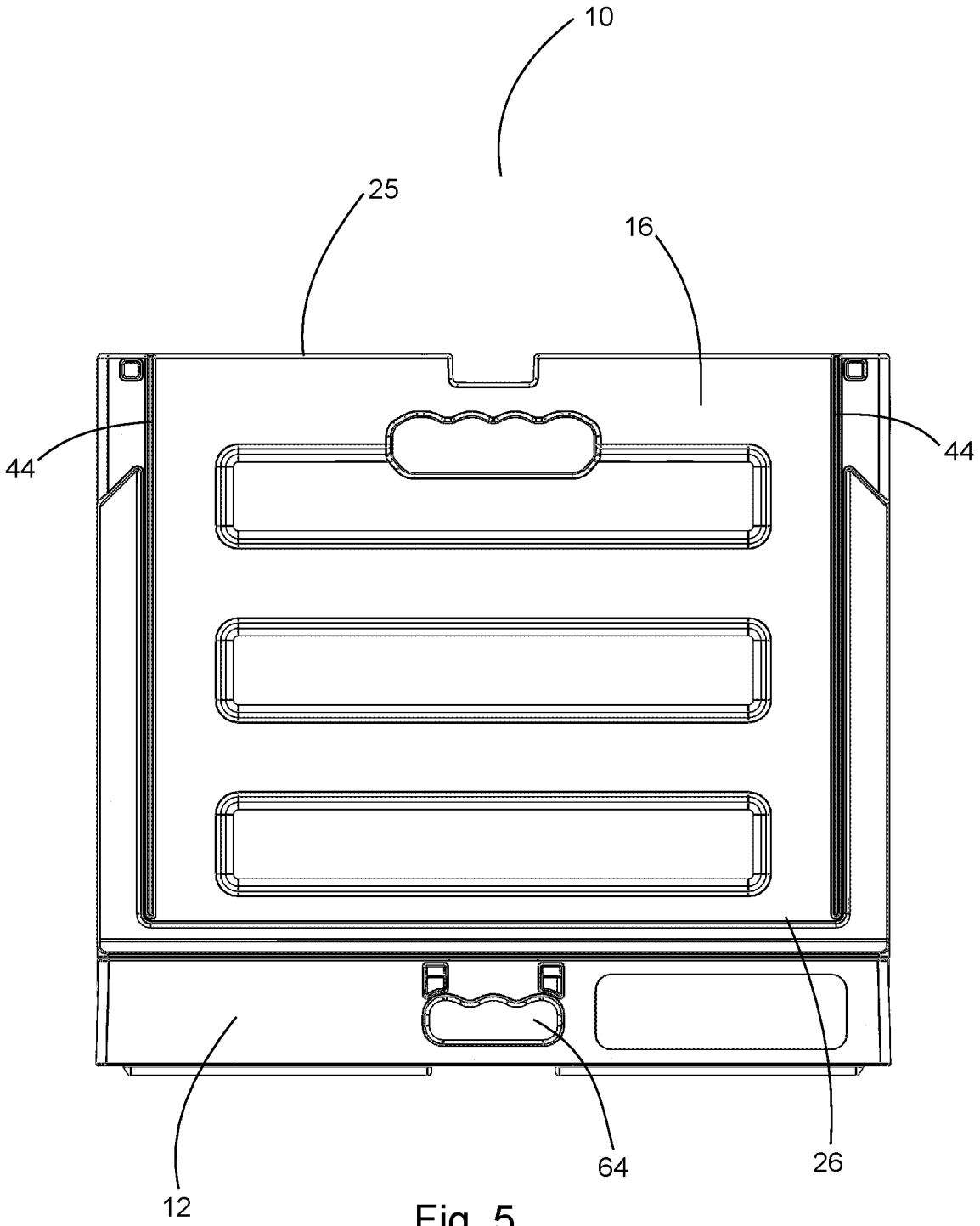
FIG. 5 is a side view of the container of FIG. 1, with the lid removed.
Figure 6:
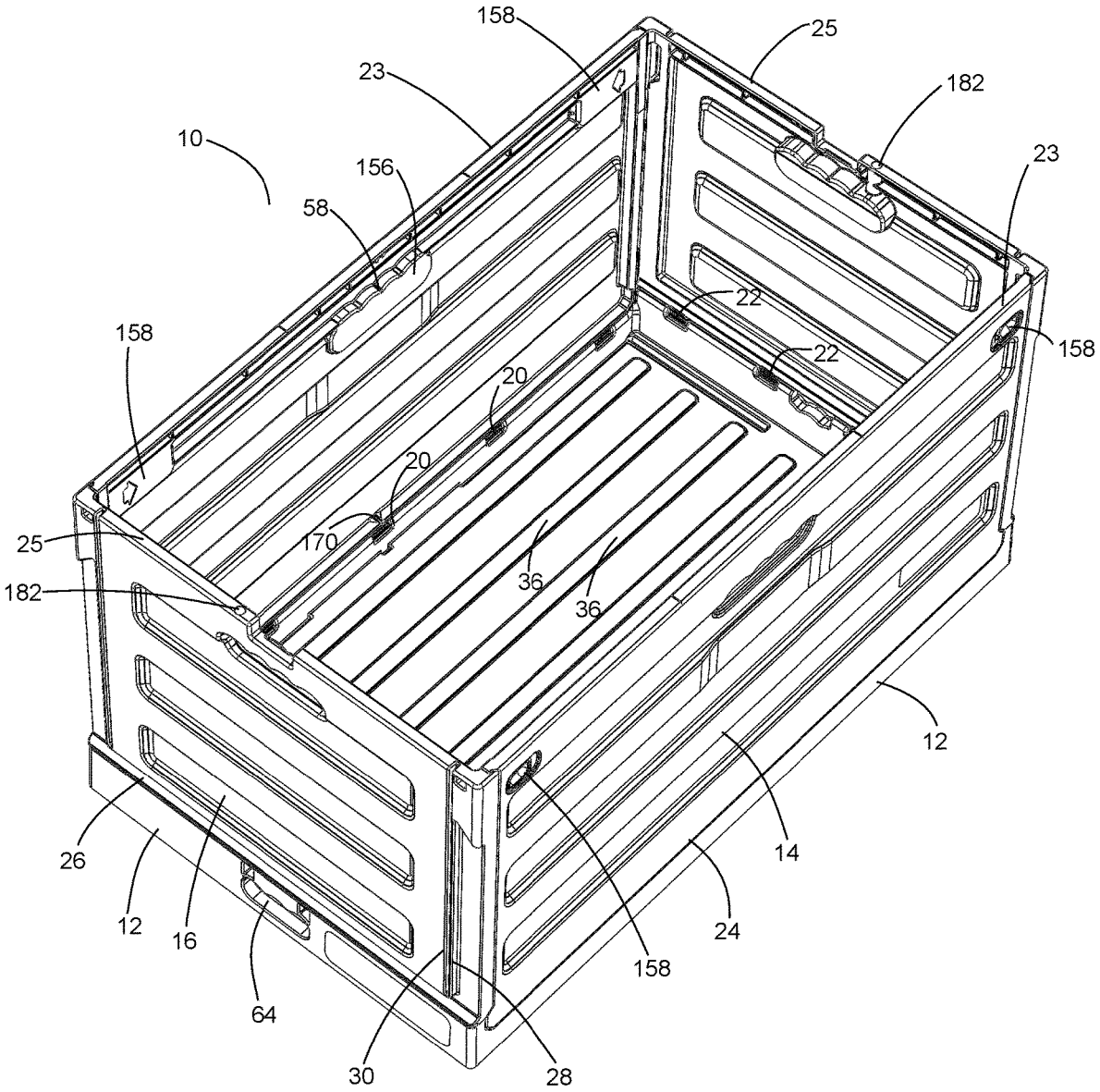
FIG. 6 is a top perspective view of the container with the lid removed.

Referring to FIGS. 1 to 10, a container 10 in accordance with some embodiments comprises a base 12, two opposed first walls 14 connected to the base 12, and two opposed second walls 16 connected to the base 12. FIGS. 1 to 5 depict the container 10 in an upright configuration, in which the first and second walls 14, 16 are substantially upright with respect to the base 12. The container 10 may further comprise a lid 18 that may be removably attachable, as described later.

In some embodiments, such as in the embodiment shown in FIGS. 1 to 10, the first walls 14 have a length that is longer than that of the second walls 16; however, it is understood that the relative lengths of the first walls 14 and the second walls 16 may vary. In some embodiments, a length of the first walls 14 may be at least double a height of the second walls 16, such that when the container 10 is in an collapsed configuration (as depicted, for example, in FIGS. 6 to 8), the second walls 16 do not overlap and interfere with each another. The base 12, the first walls 14, the second walls 16, and the lid 18 may be made from plastic, such as by injection molding.

Figure 8:
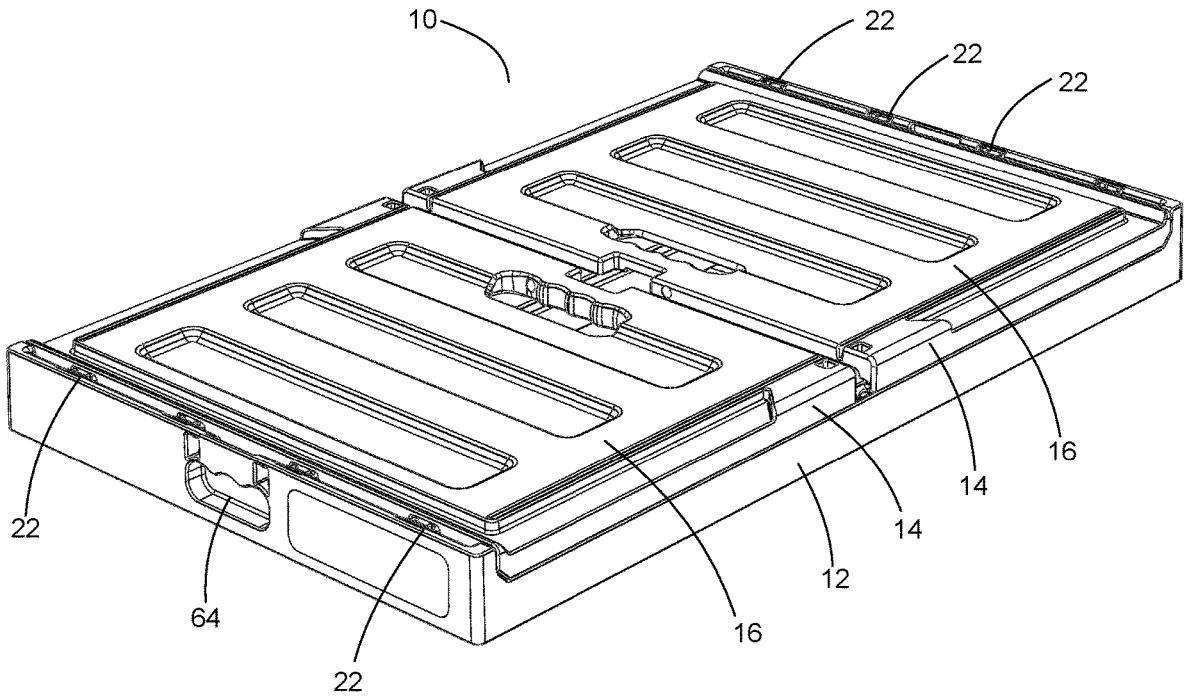
FIG. 8 is a top perspective view of the container in the collapsed configuration, with the lid removed.
Figure 9:
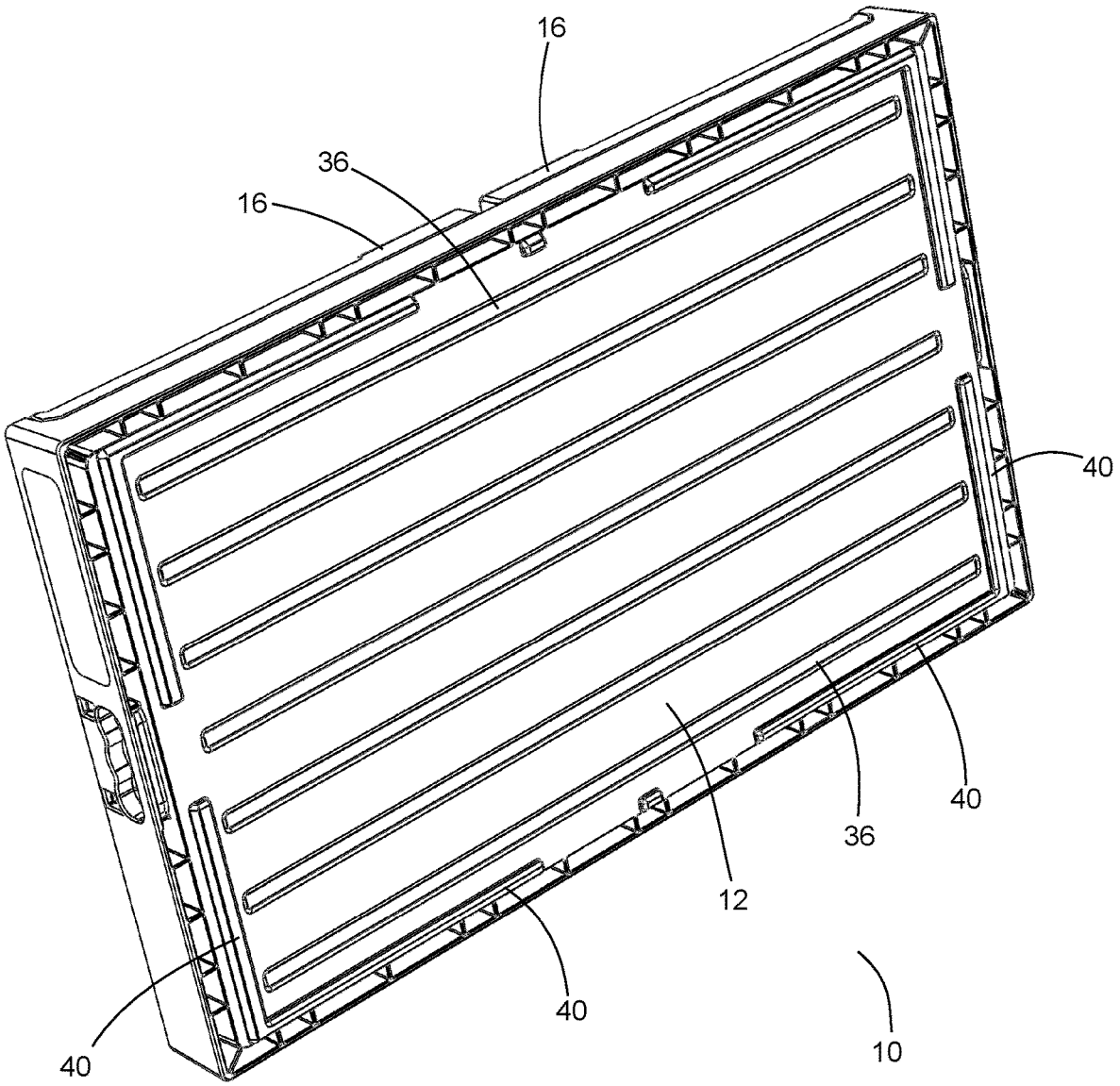
FIG. 9 is a bottom perspective view of the container in the collapsed configuration, with the lid removed.

The first walls 14 comprise first wall upper and lower edges 23, 24, while the second walls 16 comprise second wall upper and lower edges 25, 26. The container 10 further comprises one or more first hinge members 20 that are configured to connect the first walls 14 proximate to the first wall lower edges 24 to the base 12. Similarly, the container 10 further comprises one or more second hinge members 22 that are configured to connect the second walls 16 proximate to the second wall lower edges 26 to the base 12. The first and second hinge members 20, 22 are configured to allow the first and second walls 14, 16, respectively, to move hingedly with respect to the base 12 in order to transition the container 10 between the upright configuration (as shown in FIG. 1) and the collapsed configuration (as shown in FIG. 8).

The first walls 14 further comprise first wall lateral edges 28, and the second walls further comprise second wall lateral edges 30. When the container 10 is in the upright configuration, the first wall lateral edges 28 engage with the second wall lateral edges 30. For example, referring to FIGS. 61 and 62, in one embodiment, the first walls 14 may comprise protruding teeth 150 that extend outwardly from the first wall lateral edges 28. The second walls 16 may comprise corresponding grooves 152 that are formed proximate the second wall lateral edges 30. The teeth 150 are adapted to detachably engage with the grooves 152. As depicted in FIG. 62, the teeth 150 may be substantially triangular in shape, with the grooves 152 substantially corresponding in shape in order to receive the teeth 150. The teeth 150 and the grooves 152 may extend along substantially an entire height of the first and second walls 14, 16, respectively to provide continuous support along substantially the entire height of the first and second walls 14, 16. The substantially triangular shape of the teeth 150 and the grooves 152 may assist in allowing the first and second walls 14, 16 to pull more tightly together. It is understood that other methods of securing the first and second walls 14, 16 together are also possible.

The container 10 may be transitioned between the upright and collapsed configurations using one or more tab members 158. The tab members 158 may be located proximate to corners of the first walls 14, proximate to the first wall upper edges 23. In some embodiments, the tab members 158 are spring-loaded, such that in a relaxed state, the tab members 158 are configured to fit within corresponding pockets 160 formed in the second walls 16. When the container 10 is in the upright configuration, the engagement of the tab members 158 within the pockets 160 act to hold the first walls 14 in place with respect to the second walls 16 and prevents the first walls 14 from folding down. In order to transition the container 10 to the collapsed configuration, the tab members 158 may be pushed inwardly along a plane of the first walls 14. This inward movement of the tab members 158 causes the tab members 158 into a compressed state and also causes the tab members 158 to disengage from the pockets 160. When the tab members 158 have fully disengaged from the pockets 160, the first walls 12 may be folded down (onto the base 12). The second walls 14 may then be folded down (onto the first walls 12 that have already been folded down), thereby placing the container 10 in the collapsed configuration.

The first and second walls 14, 16 may further comprise one or more handholds 32 that are formed on an outer surface 154 of the first and second walls 14, 16. In some embodiments, the handholds 32 may not pass completely through the first and second walls 14, 16 but instead comprise indentations 156 formed on the outer surfaces 154 of the first and second walls 14, 16. The indentations 156 are configured to allow the user is able to place his or her fingers within the indentations 156, such as to lift container 10. Portions of the first and second walls 14, 16 proximate to the handholds 32 may be thinner in thickness than other portions of the first and second walls 14, 16 to avoid undercut issues when the container 10 is being formed by injection molding.

Referring to FIG. 1, the lid 18 may be placed on top of the first and second walls 14, 16. The lid 18 comprises a downward-facing lip 34 that extends along at least a portion of the perimeter of the lid 18. When the first and second walls 14, 16 are upright (i.e. the container 10 is in the upright configuration), the lip 34 is configured to slide over the first wall upper edges 23 and the second wall upper edges 25. The lid 18 may be held in place by the engagement of the lip 34 with the first and second walls 14, 16 proximate to the first wall upper edge 23 and the second wall upper edge 25, respectively. Furthermore, the lid 18 may help prevent the first and second walls 14, 16 from folding down when the container 10 is in the upright configuration. In addition, in some embodiments, referring to FIG. 7 when the lid 18 is placed on the first and second walls 14, 16 of the container 10 in the upright configuration, the lip 34 extends substantially over the tab members 158. Because of this, it may not be possible to transition the container 10 from the upright configuration to the collapsed configuration when the lid 18 is placed n the first and second walls 14, 16.

Figure 10:
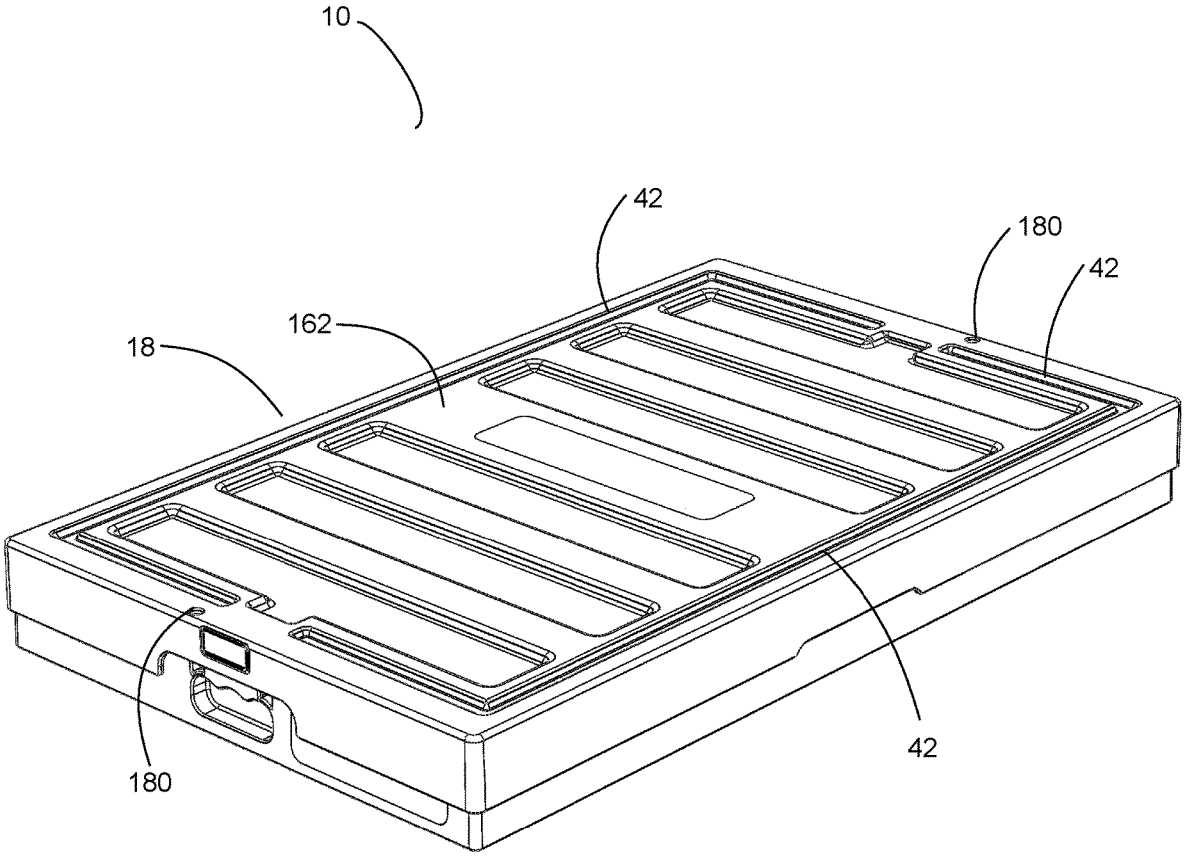
FIG. 10 is a perspective view of the container in the collapsed configuration with the lid placed on top.

Referring to FIG. 10, when the container 10 is in the collapsed configuration (i.e. the first and second walls 14, 16 are folded down), the lid 18 may be placed on top of the second walls 16 (which themselves are on top of the first walls 14). Furthermore, the lid 18 may also be placed under the base 12 when the container 10 is in either the upright or collapsed configuration. The perimeter of the base 12 may be sized such that the lip 34 is able to engage with the base 12 when the lid 18 is flipped over and placed under the base 12.

The first and second walls 14, 16 may further comprise one or more wall ribs 35 extending in a generally horizontal direction. The wall ribs 35 may provide rigidity and strength to the first and second walls 14, 16. Furthermore, the base 12 may further comprise one or more base ribs 36, again extending in a generally horizontal direction. The base ribs 36 may provide rigidity and strength to the base 12. The lid 18 may comprise one or more lid ribs 38 extending in a generally horizontal direction. The lid ribs 38 may provide rigidity and strength to the lid 18. The wall ribs 35, the base ribs 36, and/or the lid ribs 38 may be formed as indentations extending along at least a portion of the first and second walls 14, 16, the base 12, and/or the lid 18.

Referring to FIGS. 11 to 17, two or more of the containers 10 may be stacked on top of each other. For example, FIG. 11 depicts a top view of two of the containers 10 (i.e. 10*a*, 10*b*) stacked together. FIG. 12 is a cross-sectional view of containers 10*a*, 10*b*, taken along A-A of FIG. 11. FIG. 13 is a cross-sectional view of the containers 10*a*, 10*b*, taken along B-B of FIG. 11. FIG. 14 depicts a magnified view of portion C of FIG. 13. In some embodiments, the base 12 of the container 10 comprises one or more downward-extending protrusions 40 that run inward of a perimeter of the base 12. The lid 18 of the container 10 comprises upper and lower lid surfaces 162, 164, with a corresponding first lid channel 42 formed on the upper lid surface 162 that runs inward of a perimeter of the lid 18. When the container 10*a* is stacked on top of the container 10*b*, the protrusion 40*a* on the container 10*a* is configured to fit within the first lid channel 42*b* on the container 10*b*. This engagement of the protrusion 40*a* with the first lid channel 42*b* may assist in holding the container 10*a* in place above the container 10*b* and prevents any lateral movement of the container 10*a* with respect to the container 10*b*.

In some embodiments, at least portions of the lid 18 that form the first lid channel 42 may have reduced wall thickness, as compared to other portions of the lid 18.

In other embodiments, the geometry of the containers 10 is such that they are able to stack, either with or without the lid 18. For example, when the lid 18 is not present, the base 12*a* of the container 10*a* would rest directly on the first and second wall upper edges 23*b*, 24*b* of the container 10*b*.

Figure 15:
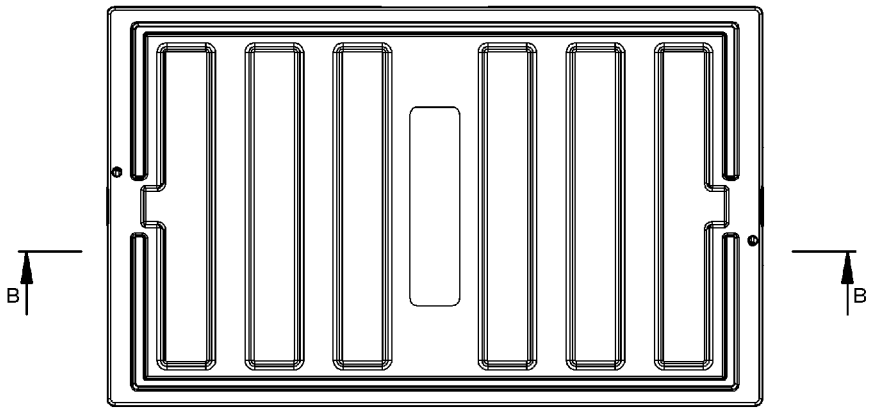
FIG. 15 is a top view of two containers (in the collapsed configuration and with the lids) stacked on top of each other.
Figure 16:
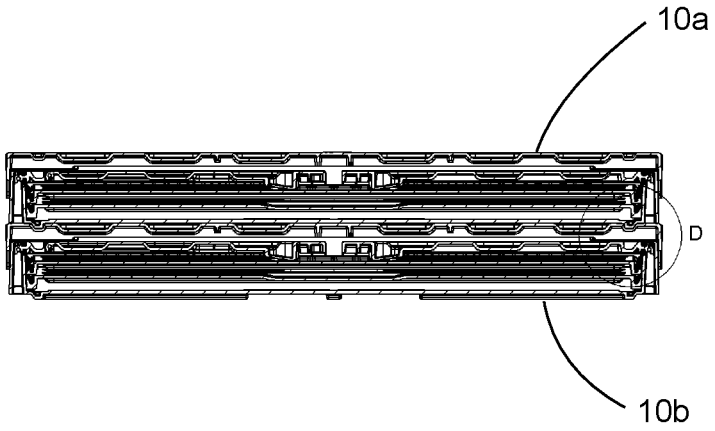
FIG. 16 is a cross-sectional view of FIG. 15 taken along B-B of FIG. 15.
Figure 17:
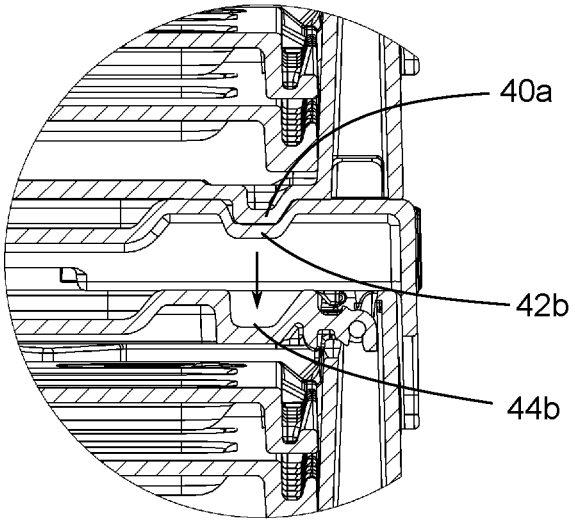
FIG. 17 is a magnified view of the portion D of FIG. 16.
Figure 18:
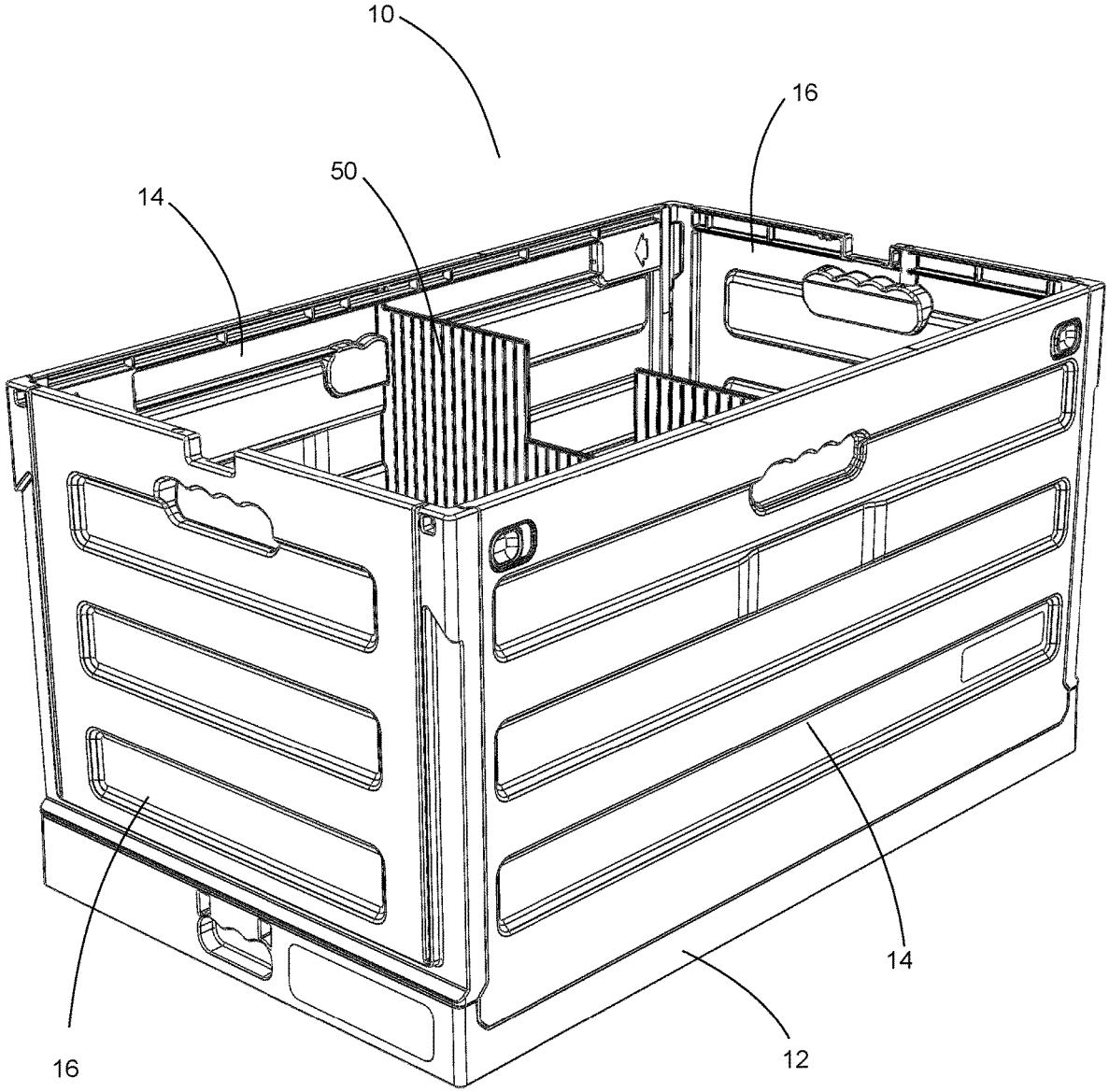
FIG. 18 is a perspective view of another embodiment of the container, with a partition.
Figure 19:
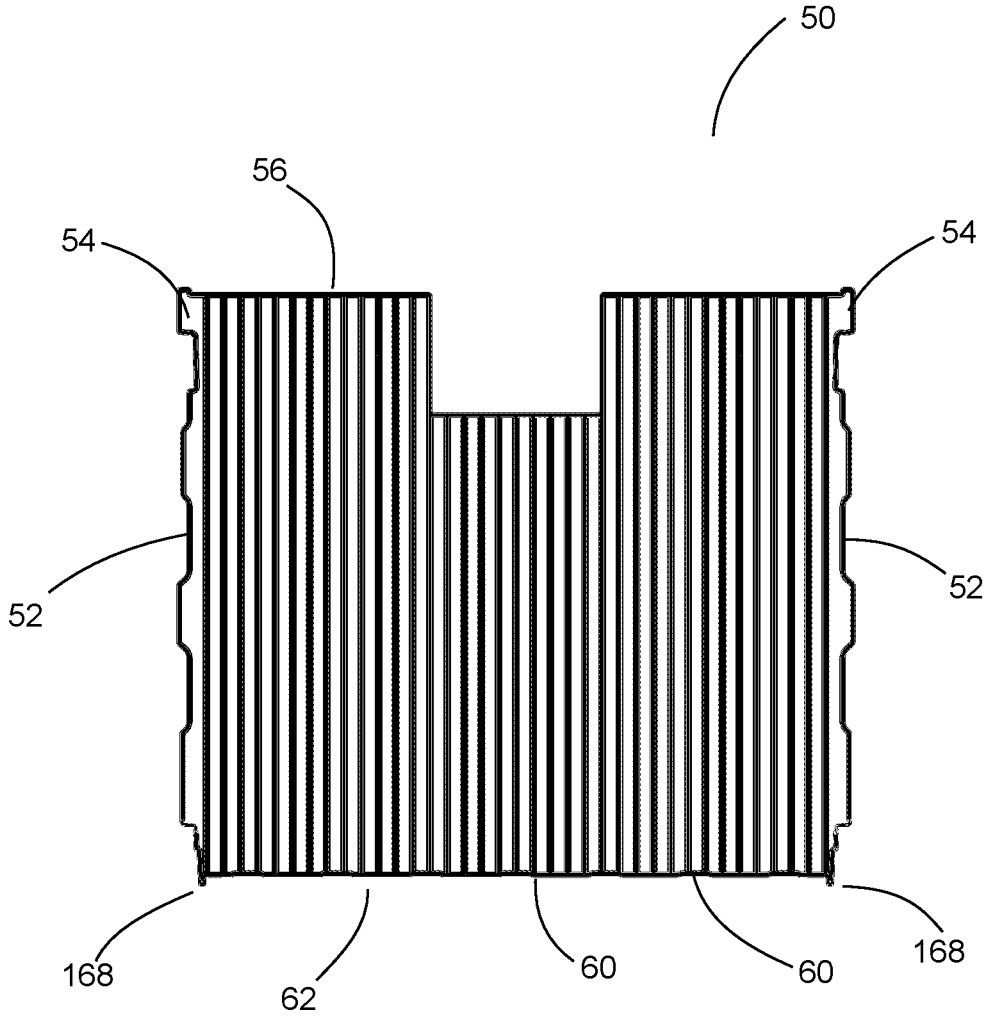
FIG. 19 shows the partition.

When the containers 10 are in the collapsed configuration, the containers 10 may still be stacked on top of each other. For example, FIG. 15 depicts container 10*a* stacked on top of container 10*b*, where both containers 10*a*, 10*b* are in their collapsed configurations. FIG. 16 is a cross-sectional view of FIG. 15, taken along B-B of FIG. 15. FIG. 17 is a magnified cross-sectional view of the portion D of FIG. 16, depicting the interaction between the containers 10*a*, 10*b*. As when the containers 10*a*, 10*b* are in their upright configurations, the protrusion 40*a* on the container 10*a* is configured to fit within the first lid channel 42*b* on the container 10*b* to hold the container 10*a* in place. However, in addition, the second walls 16 comprise wall channels 44 extending substantially parallel to and offset from the second wall lateral edges 30. The wall channels 44 may be sized such that when the second walls 16 are collapsed (such as when the container is in the collapsed configuration), the first lid channel 42 may be able to engage with the wall channels 44. Therefore, as shown in FIG. 17, the protrusion 40*a* of the container 10 is configured to engage with the first lid channel 42*b* of the container 10*b*, which in turn may be configured to engage with the wall channel 44*b* of the container 10*b* (as indicated by the arrow).

In some embodiments, two or more of the containers 10 may be stacked on top of each other to form a shelf unit. In this embodiment, one or the first walls 14 may be folded down while remaining ones of the first and second walls 14, 16 remain upright. The containers 10 can then be stacked on top of each other to form a shelf unit. For example, a shelf unit with three shelves may be formed by stacking the containers 10*a*, 10*b*, 10*c* (such as in FIG. 51) on top of each other. One of the first walls 14 may be collapsed in each of the containers 10*a*, 10*b*, 10*c* in order to form the shelves in the shelf unit (see, for example, FIG. 59 for an example of the container 10 with one of the first walls 14 folded down). As with other embodiments, the protrusion 40*a* on the container 10*a* fits within the first lid channel 42*b* on the container 10*b*, and the protrusion 40*b* on the container 10*b* fits within the first lid channel 42*c* on the container 10*c*.

Referring to FIGS. 18 to 24, in some embodiments, the container 10 further comprises one or more partitions 50 that are removably attachable to the container 10. The partition 50 may be sized to engage with the first walls 14 and the base 12 when attached to the container 10. In one embodiment, referring to FIG. 19, the partition 50 comprises partition lateral edges 52 that are adapted to fit within and engage the first walls 14. In particular, the partition lateral edges 52 are adapted to fit within and engage the contours formed by the wall ribs 35 on the first walls 14 when the partition 50 is attached to the container 10.

Figure 20:
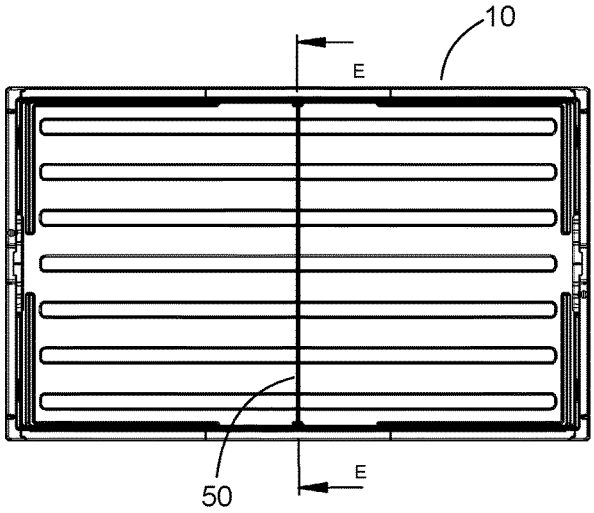
FIG. 20 is a top view of the container with the partition.
Figure 21:
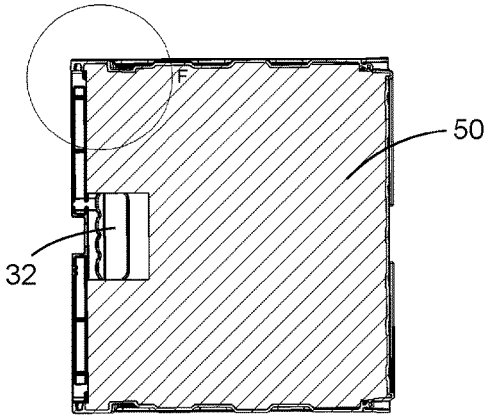
FIG. 21 is a cross-sectional view of FIG. 20 taken along E-E of FIG. 20.
Figure 22:
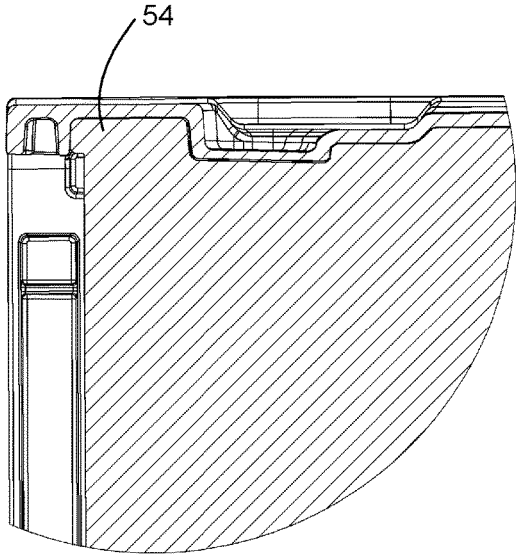
FIG. 22 is a magnified view of portion F of FIG. 21.

FIG. 20 depicts a top view of the container 10 with the partition 50 attached. FIG. 21 is a cross-sectional view, taken along E-E of FIG. 20. FIG. 22 is a magnified view of the portion F of FIG. 21. The partition 50 further comprises a partition upper edge 56 and a partition lower edge 62 extending between the partition lateral edges 52. The partition may comprise partition tabs 54 located on the partition lateral edges 52 proximate to the partition upper edge 56. The partition tabs 54 are configured to engage with the handholds 32 when the partition 50 is attached to the container 10. In particular, the handhold 32 may comprises one or more handhold creases 58 that formed on an upper surface of the indentation 156. The handhold crease is configured to receive the partition tab 54 when the partition 50 is attached to the container 10, thereby holding the partition 50 in place. The partition 50 may further comprise one or more partition contours 60 formed on the partition lower edge 62. The partition contours 60 are configured to correspond to the shape and contours of the base 12, and in particular, the base ribs 36.

Figure 23:
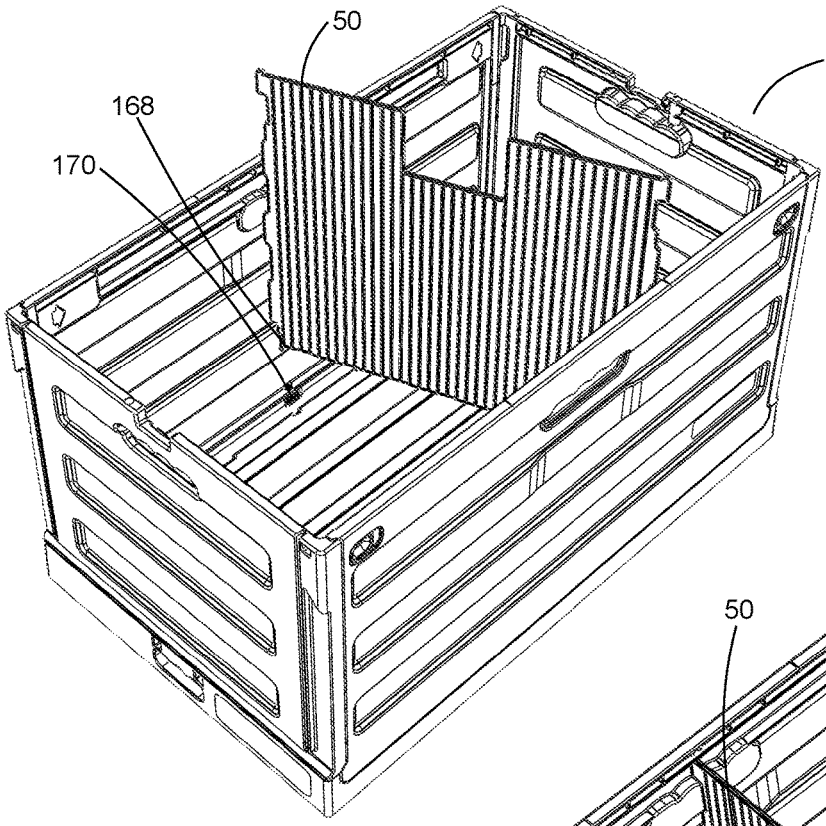
FIG. 23 shows the container with the partition partially inserted.
Figure 24:
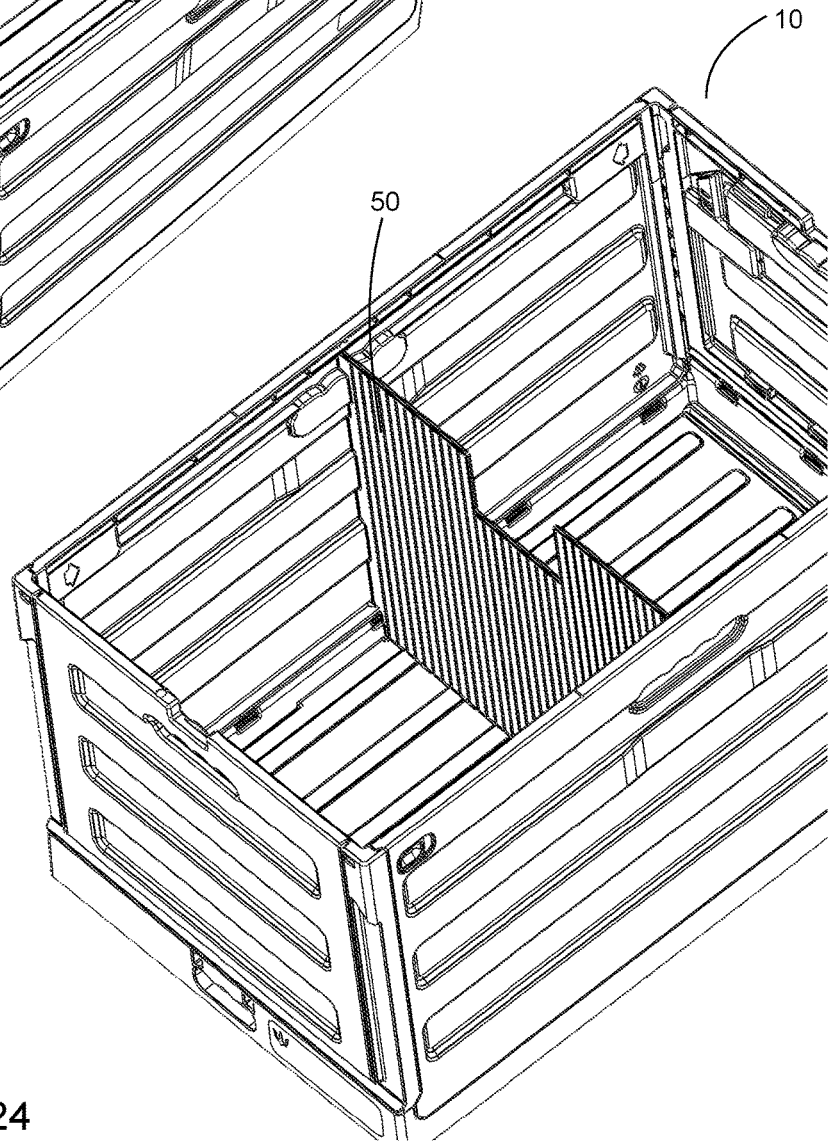
FIG. 24 shows the container with the partition inserted.
Figure 25:
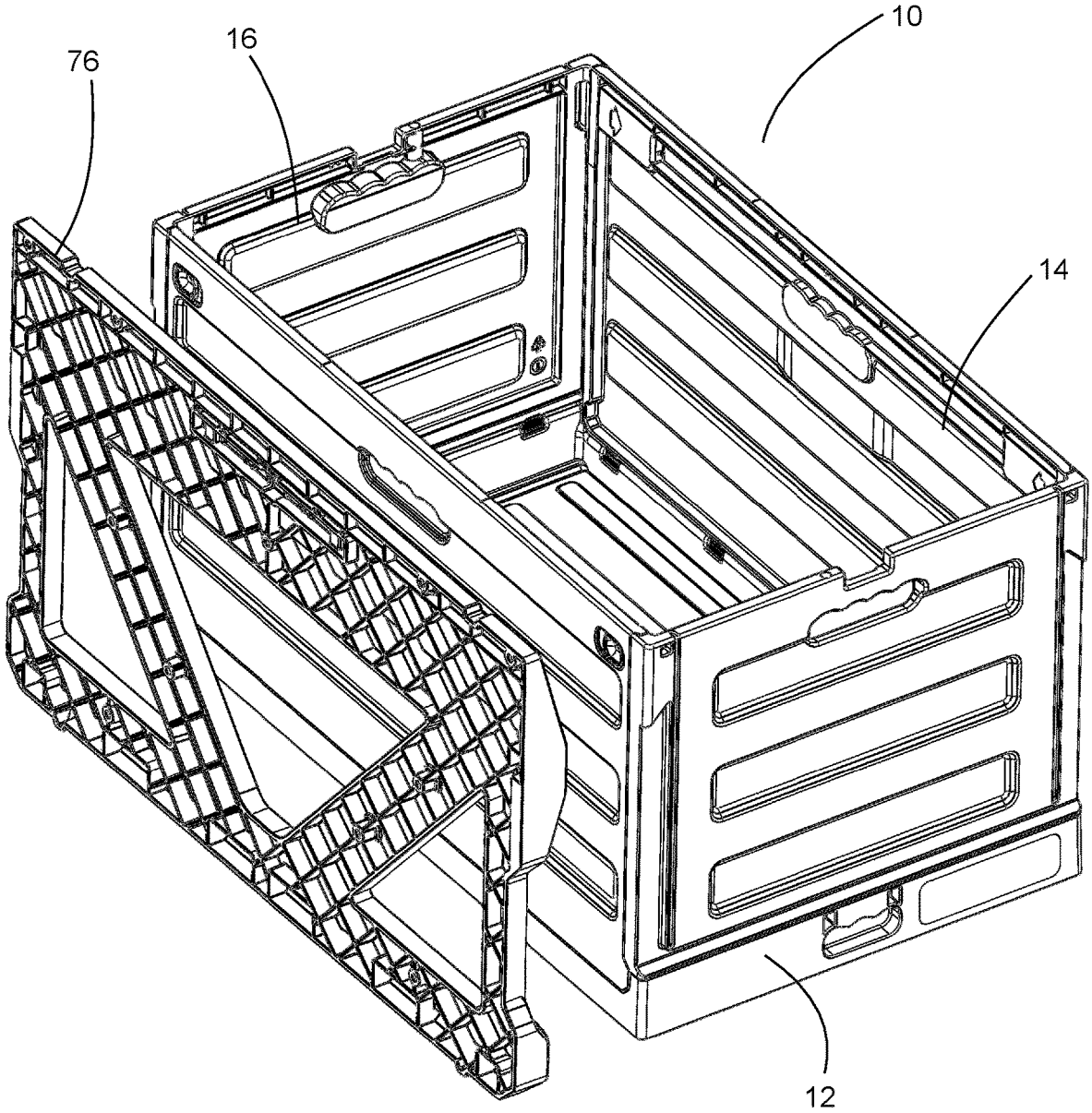
FIG. 25 shows the container with a bracket.

The partitions 50 may further comprise partition protrusions 168 that extend from the partition lower edge 62, proximate to the partition lateral edges 52. FIG. 23 depicts the container 10 with the partition 50 partially inserted, while FIG. 24 depicts the container 10 with the partition attached. The base 12 further comprises base openings 170 that are configured to accept the partition protrusions 168 when the partition 50 is attached to the container 10. The engagement of the partition protrusions 168 with the base openings 170 may assist in helping to place the partition 50 in the correct position when attaching the partition 50 to the container 10.

The partition 50 may be removed from and attached to the container 10 as needed. In some embodiments, when the container 10 is transitioned to the collapsed configuration, the partition 50 may be placed and stored on top of the base 12 before the first and second walls 14, 16 are folded down on top of the base 12.

Figure 53:
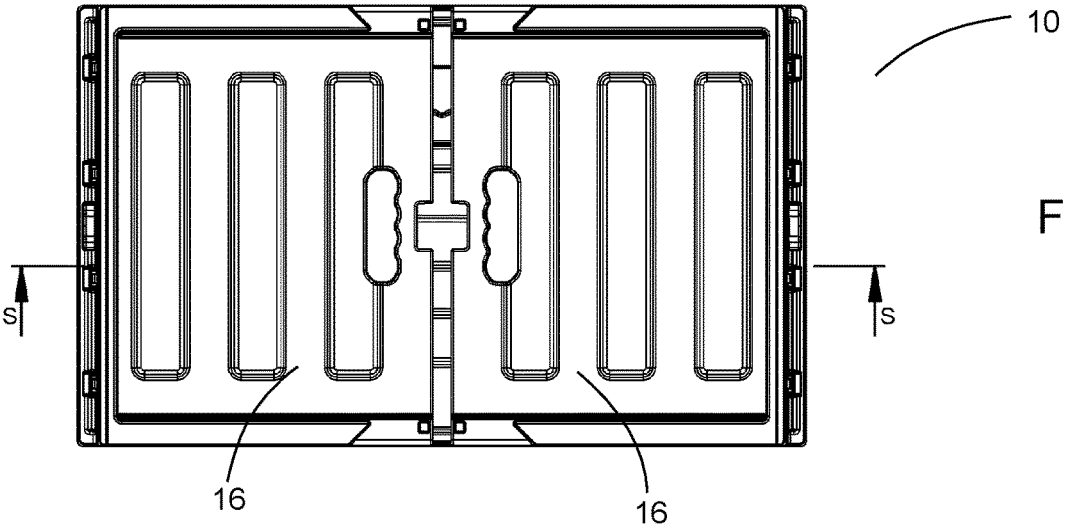
FIG. 53 is a top view of the container with the second walls folded down onto the first walls.
Figure 54:
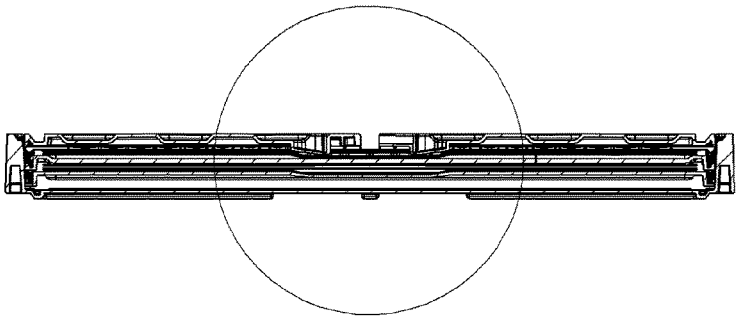
FIG. 54 is a cross-sectional view of FIG. 53 taken along S-S of FIG. 53.
Figure 55:
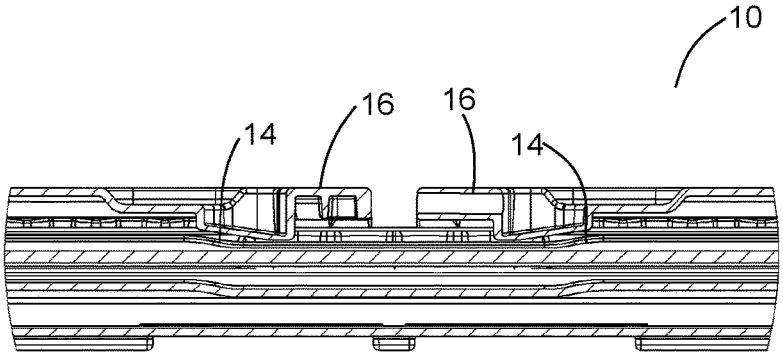
FIG. 55 is a magnified view of the portion T of FIG. 54.

Referring to FIGS. 53 to 55, in some embodiments, when the handholds 32 on the second walls 16 are folded down onto the first walls 14, the second walls 16 may be folded down as much as possible. FIG. 53 depicts a top view of the container 10 with the second walls 16 folded down onto the first walls 14. FIG. 54 is a cross-sectional view of FIG. 53, taken along S-S of FIG. 53. FIG. 55 is a magnified view of the portion T of FIG. 54. In order to allow the second walls 16 to be folded down further, in some embodiments, a portion of the first walls 14 may be curved in order to allow for the second walls 16 (and in particular, the indentations 156 of the handholds 32 of the second walls 16) to fold onto the first walls 14 as much as possible.

Figure 56:
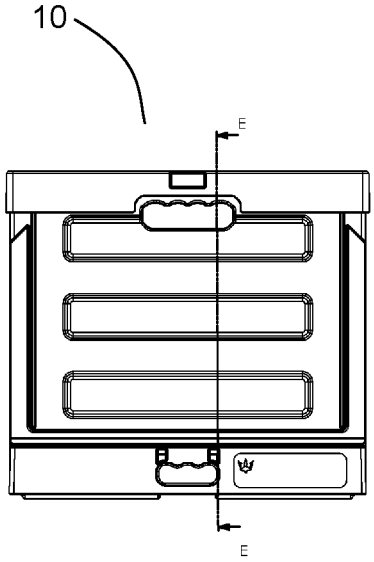
FIG. 56 is a side view of the container with the lid attached.
Figure 57:
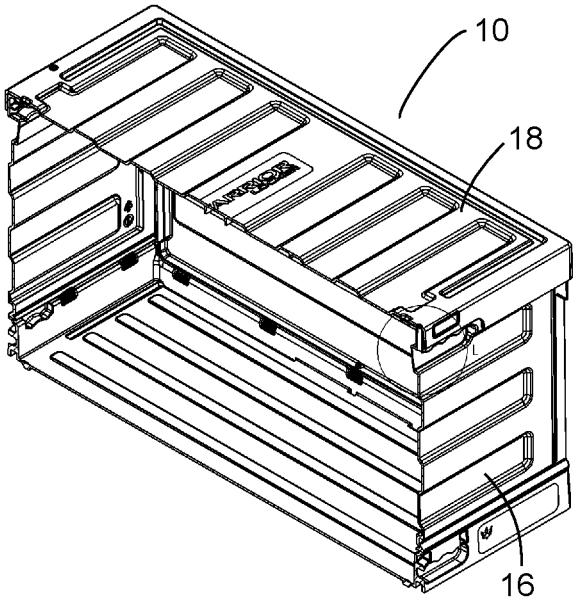
FIG. 57 is a cross-sectional view of FIG. 56 taken along E-E of FIG. 56.
Figure 58:
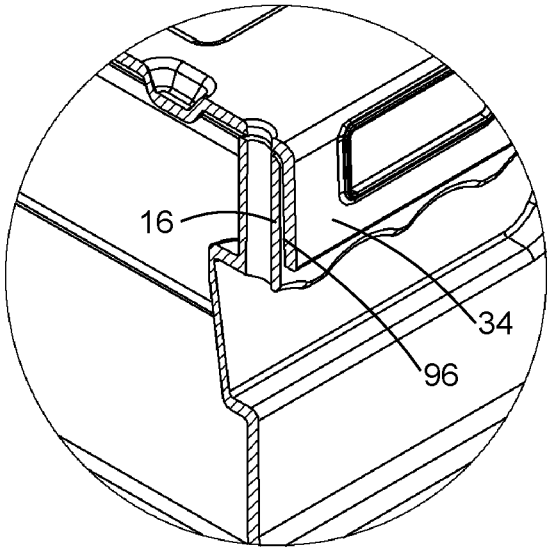
FIG. 58 is a magnified view of the portion L of FIG. 57.

Referring to FIGS. 56 to 58, in some embodiments, the lip 34 is not oriented substantially parallel to the first and second walls 14, 16 but is instead flared slightly outwards, to allow for the user to insert his or her fingers between the lip 34 and the first or second walls 14, 16 in order to more easily remove the lid 18. For example, FIG. 56 is a side view of the container 10 with the lid 18 attached. FIG. 57 is a cross-sectional view of FIG. 56, taken along E-E of FIG. 56. FIG. 58 is a magnified view of the portion L of FIG. 57. As best shown in FIG. 58, the lip 34 is slightly flared out, providing a gap 96 between the lip 34 and the first and second walls 14, 16.

Figure 59:
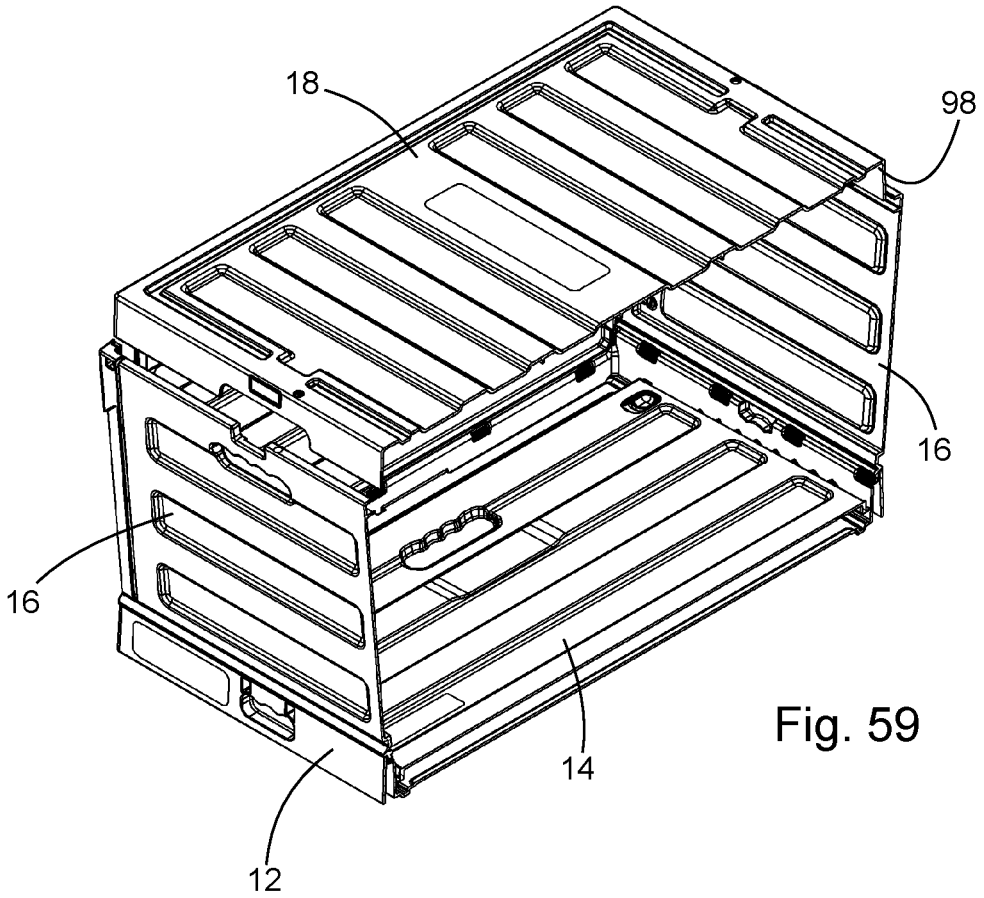
FIG. 59 shows the container with one of the first walls folded down.
Figure 60:
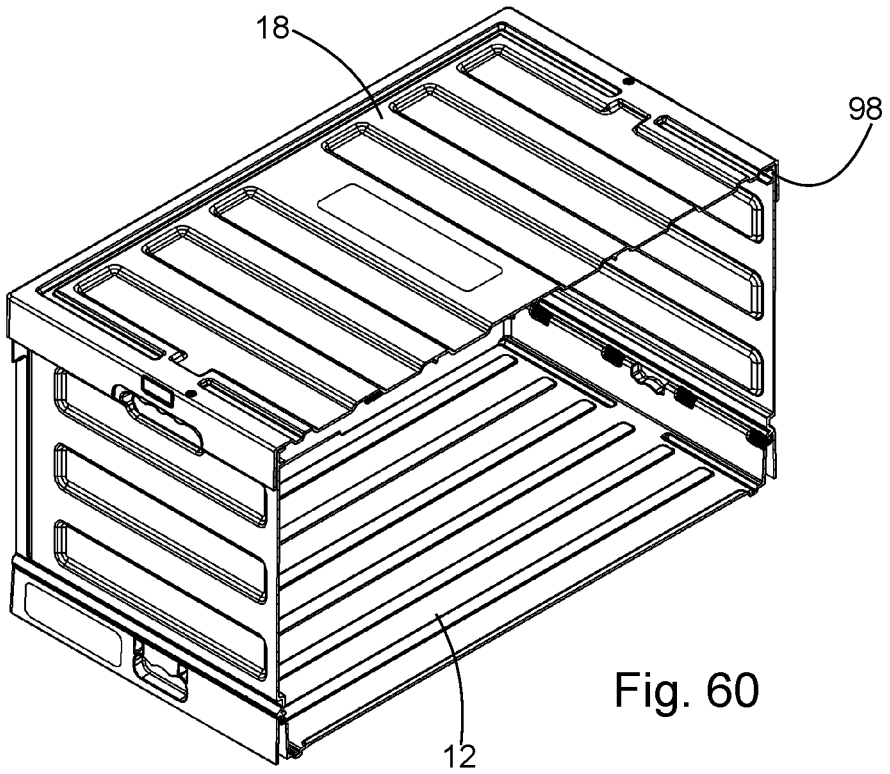
FIG. 60 is a cross-sectional view showing the container with the lid attached.

Referring to FIGS. 59 and 60, the lid 18 may comprise a second lid channel 98 that is formed on the lower lid surface 164 of the lid 18 and runs inward of a perimeter of the lid 18. The second lid channel 98 may help to lock the first and/or second walls 14, 16 in place when the lid 18 is placed on the container 10. In particular, the second lid channel 98 may help to ensure that the first and second walls 14, 16 are not able to move. This is of benefit, particularly when the container 10 is used as part of a shelf unit, as described above. For example, FIG. 59 shows the container 10 wherein one of the first walls 14 is folded down, with the lid 18 not yet attached to the container 10. FIG. 60 is a cross-sectional view showing the container 10, with the lid 18 attached.

Figure 61:
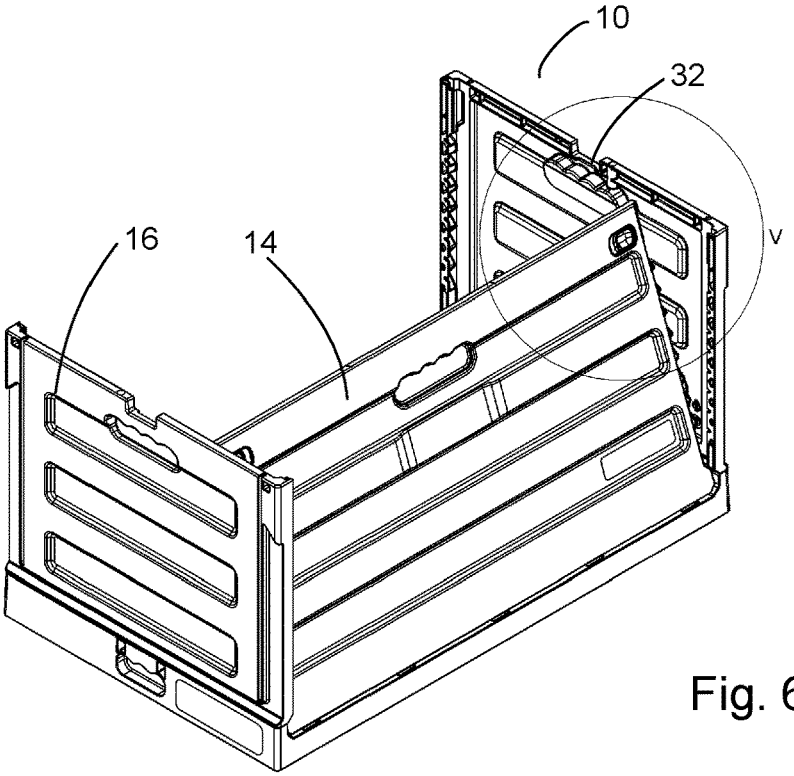
FIG. 61 shows the container with one of the first walls partially folded down.
Figure 62:
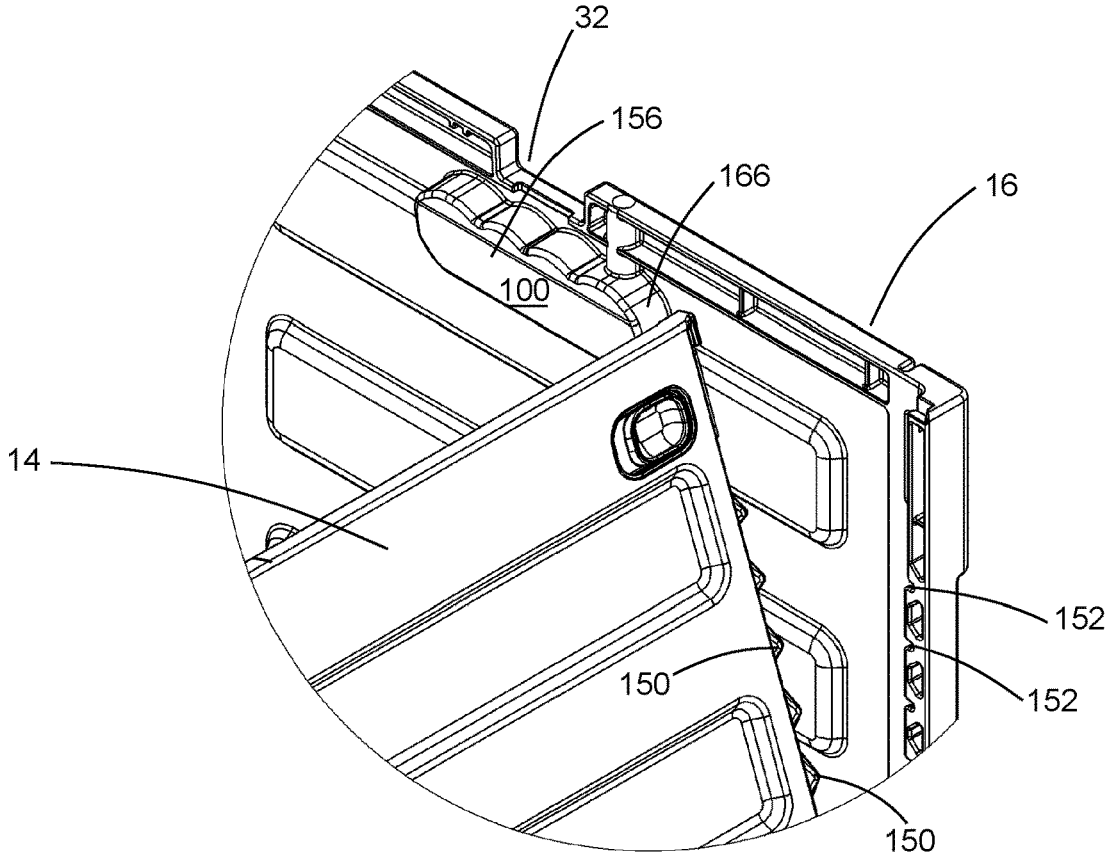
FIG. 62 is a magnified view of the portion V of FIG. 61.

Referring to FIGS. 61 and 62, in some embodiments, the handholds 32 may be sealed, such that an interior of the container 10 may not be accessed through the handholds 32. In such embodiments, the indentations 156 may comprise an indent wall 100 that is angled (i.e. the indent wall 100 for the indentations 156 on the first walls 14 are not parallel to the first wall 14, and/or the indent wall 100 for the indentations 156 on the second walls 16 are not parallel to the second wall 16). The indentations 156 may further comprise an indent sidewall 166 extending between the indent wall 100 and the first or second walls 14, 16. In some embodiments, only the indent walls 100 for the indents 156 on the second walls are angled. FIG. 61 depicts the container 10 with one of the first walls 14 partially folded down. FIG. 62 is a magnified view of the portion V of FIG. 61. As best shown in FIG. 62, the angling of the indent wall 100 is such that as the first walls 14 are folded down, the handholds 32 of the second walls 16 do not interfere with the movement of the first walls 14.

Referring to FIG. 1, in some embodiments, the base 12 may comprise a base lower edge 74. The base 12 may comprise one or more grip portions 64 formed below the second walls 16, proximate to the base lower edge 74. The grip portions 64 are configured to allow the user to grasp the container 10 from the bottom.

Figure 26:
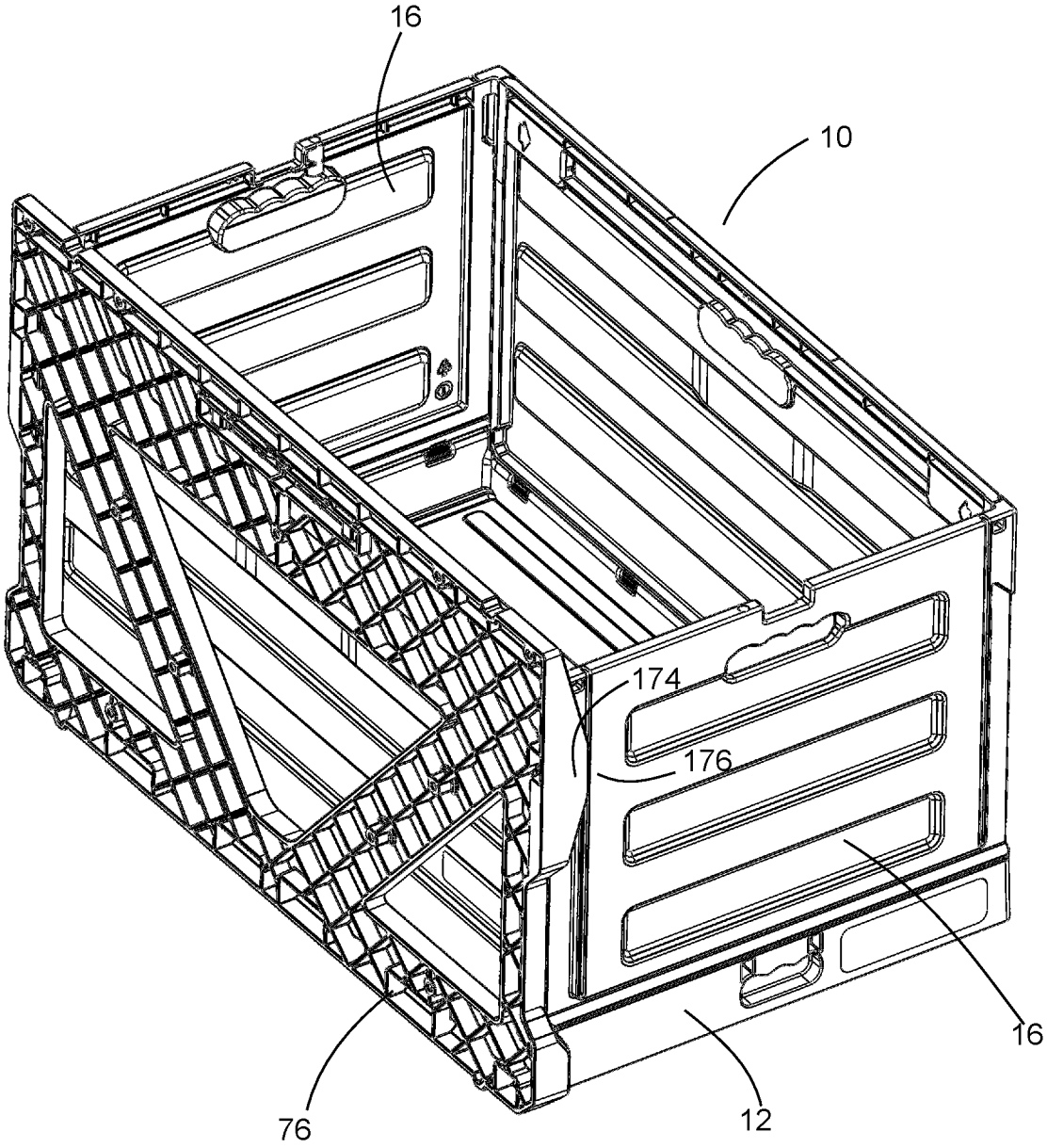
FIG. 26 shows the container attached to the bracket.
Figure 39:
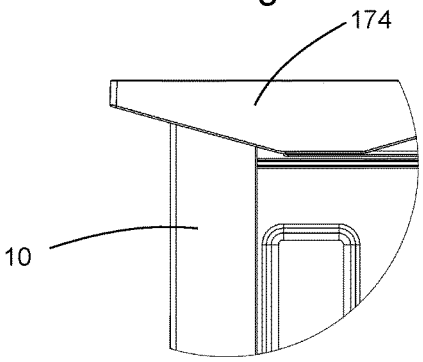
FIG. 39 is a magnified view of the portion M of FIG. 38.
Figure 40:
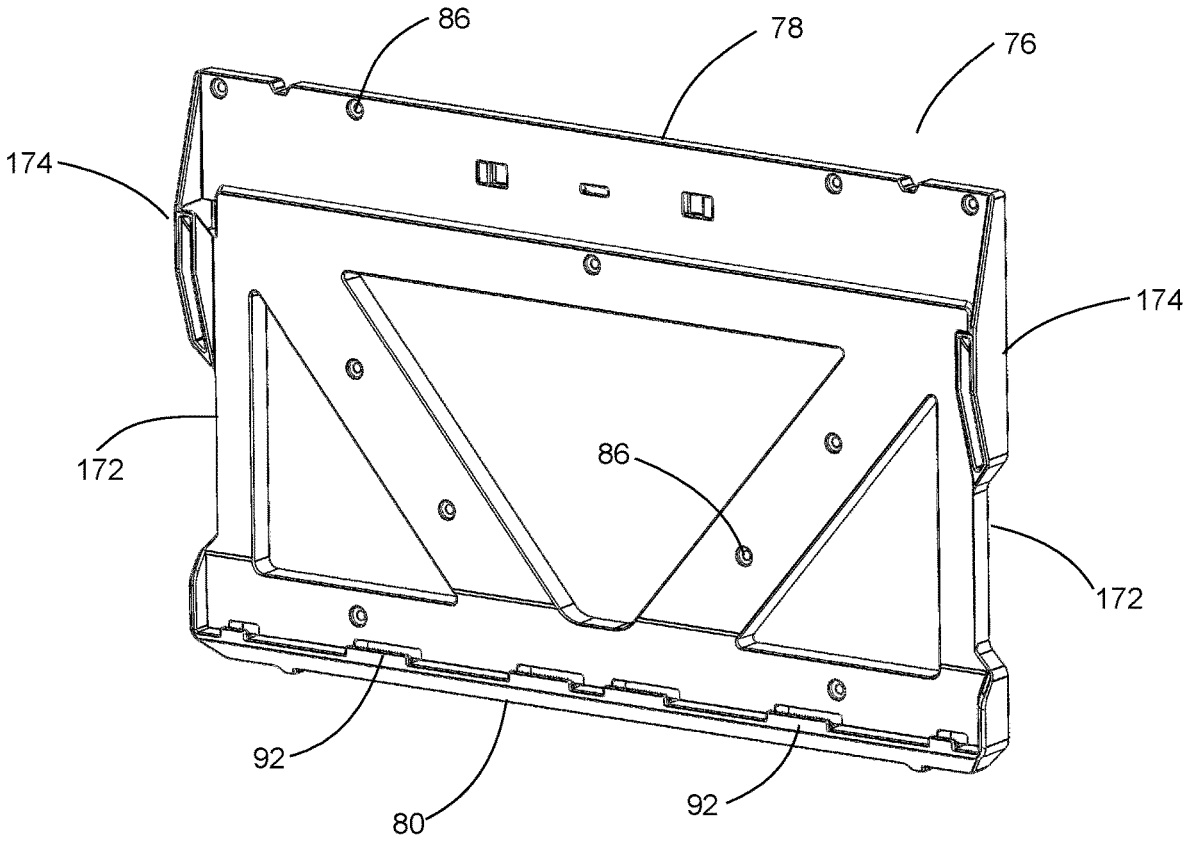
FIG. 40 is a perspective view of the bracket.
Figure 41:
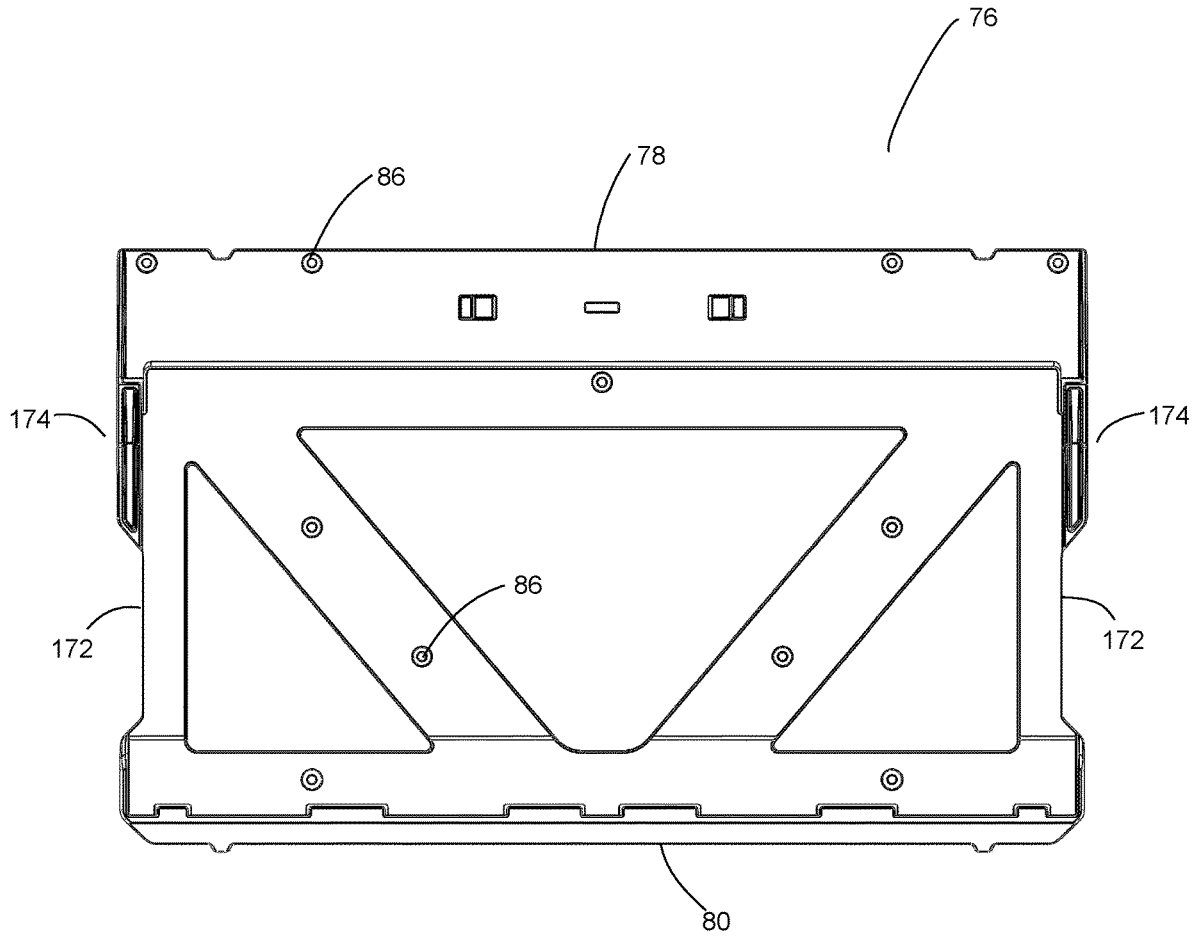
FIG. 41 is a front view of the bracket.

Referring to FIGS. 25 to 50, a bracket 76 may be provided to mount the container 10 on a wall. Referring to FIGS. 40 and 41, the bracket 76 comprises bracket upper and lower edges 78, 80 and bracket lateral edges 172. The bracket 76 may further comprise attachment members 174 located proximate to the bracket lateral edges 172. The attachment members 174 are configured to engage with the second walls 16 of the container 10. Referring to FIG. 26, the second walls 16 comprise a slot 176 formed along the second walls 16 proximate to the second wall lateral edges 30. Referring to FIGS. 27 to 35, the slots 176 comprise an angled member 177 that is configured to engage with the attachment members 174. The attachment members 174 comprise a corresponding angled surface 178 (e.g. corresponding in angularity to the angled member 177) that is configured to engage within the slot 176 and rest against the angled member 177. Because of the angularity of the angled member 177 and the angled surface 178, once the attachment members 174 are engaged with the slots 176, lateral movement of the container 10 may not be possible. As shown in FIGS. 27 to 35, in order for the container 10 to engage with the bracket 76, the container 10 may be attached from one direction (i.e. from above). This is because of the angularity of the angled member 176 and the angled surface 178.

Figure 27:
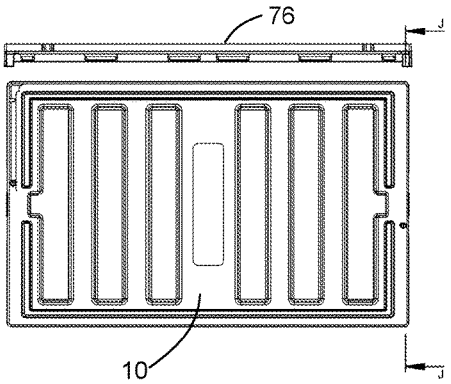
FIG. 27 is a top view of the container apart from the bracket.
Figure 28:
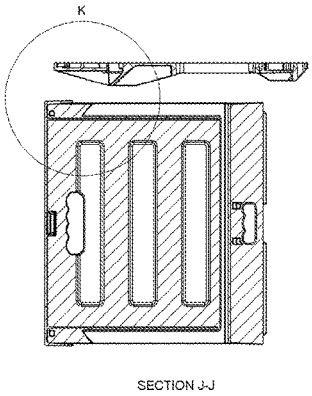
FIG. 28 is a cross-sectional view taken along J-J of FIG. 27.
Figure 29:
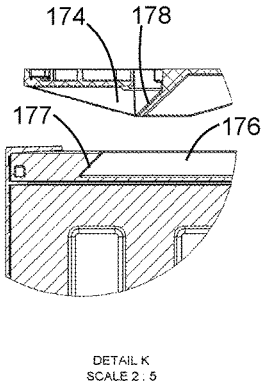
FIG. 29 is a magnified view of the portion K of FIG. 28.
Figure 30:
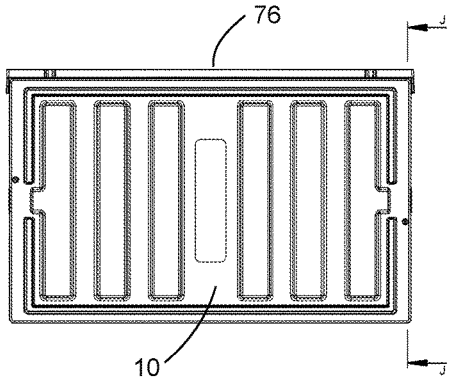
FIG. 30 is a top view of the container beginning to engage with the bracket.
Figure 31:
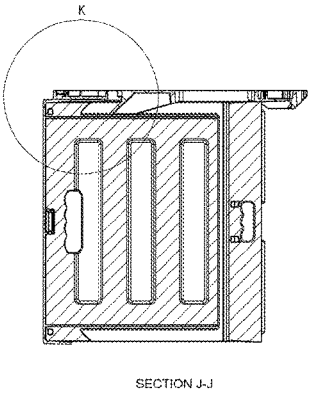
FIG. 31 is a cross-sectional view taken along J-J of FIG. 30.
Figure 32:
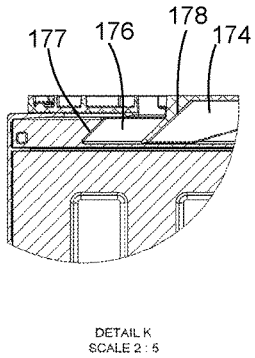
FIG. 32 is a magnified view of the portion K of FIG. 31.
Figure 33:
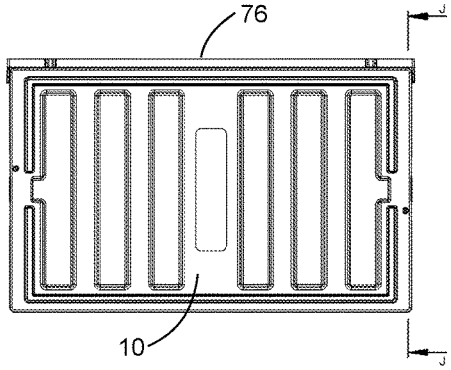
FIG. 33 is a top view of the container engaged with the bracket.
Figure 34:
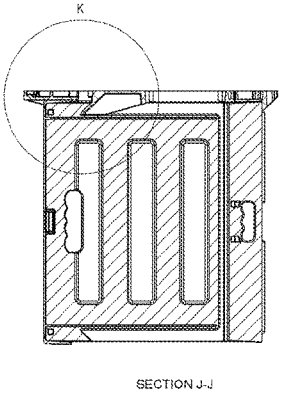
FIG. 34 is a cross-sectional view taken along J-J of FIG. 33.
Figure 35:
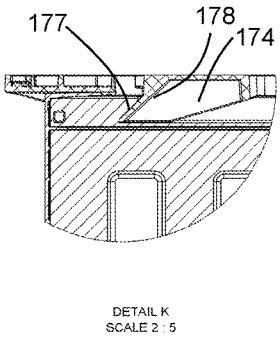
FIG. 35 is a magnified view of the portion K of FIG. 34.

FIG. 27 depicts the container 10 apart from the bracket 76. FIG. 28 is a cross-sectional view, taken along J-J of FIG. 27. FIG. 29 is a magnified view of the portion K of FIG. 28. FIG. 30 depicts the container 10 beginning to engage with the bracket 76. FIG. 31 is a cross-sectional view, taken along J-J of FIG. 30. FIG. 32 is a magnified view of the portion K of FIG. 31. FIG. 33 depicts the container 10 fully engaged with the bracket 76. FIG. 34 is a cross-sectional view, taken along J-J of FIG. 33. FIG. 35 is a magnified view of the portion K of FIG. 34.

Figure 36:
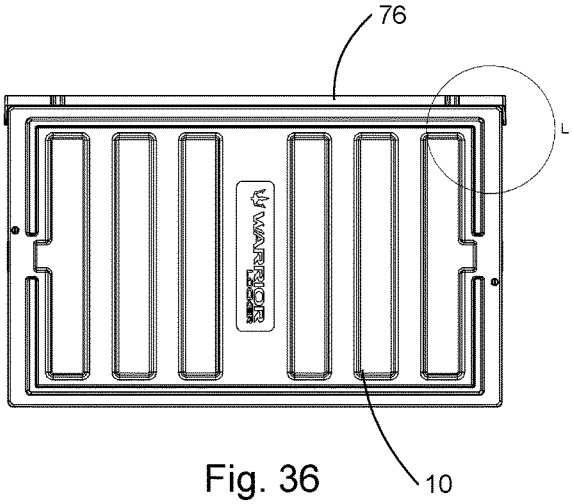
FIG. 36 is a top view of the container attached to the bracket.
Figure 38:
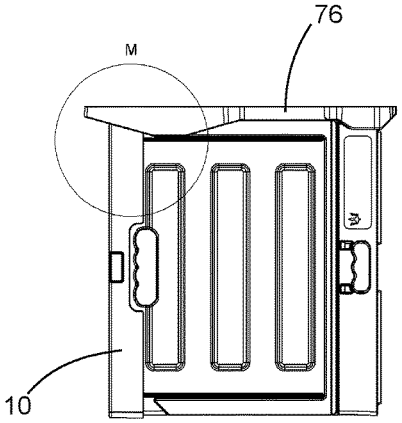
FIG. 38 is a side view of the container attached to the bracket.
Figure 37:
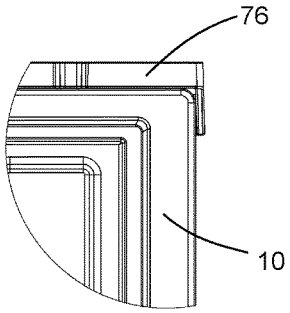
FIG. 37 is a magnified view of the portion L of FIG. 36.

FIG. 36 depicts a top view of the container 10 attached to the bracket 76. FIG. 37 is a magnified view of the portion L of FIG. 36. FIG. 38 depicts a side view of the container 10 attached to the bracket 76. FIG. 39 is a magnified view of the portion M of FIG. 38.

Figure 49:
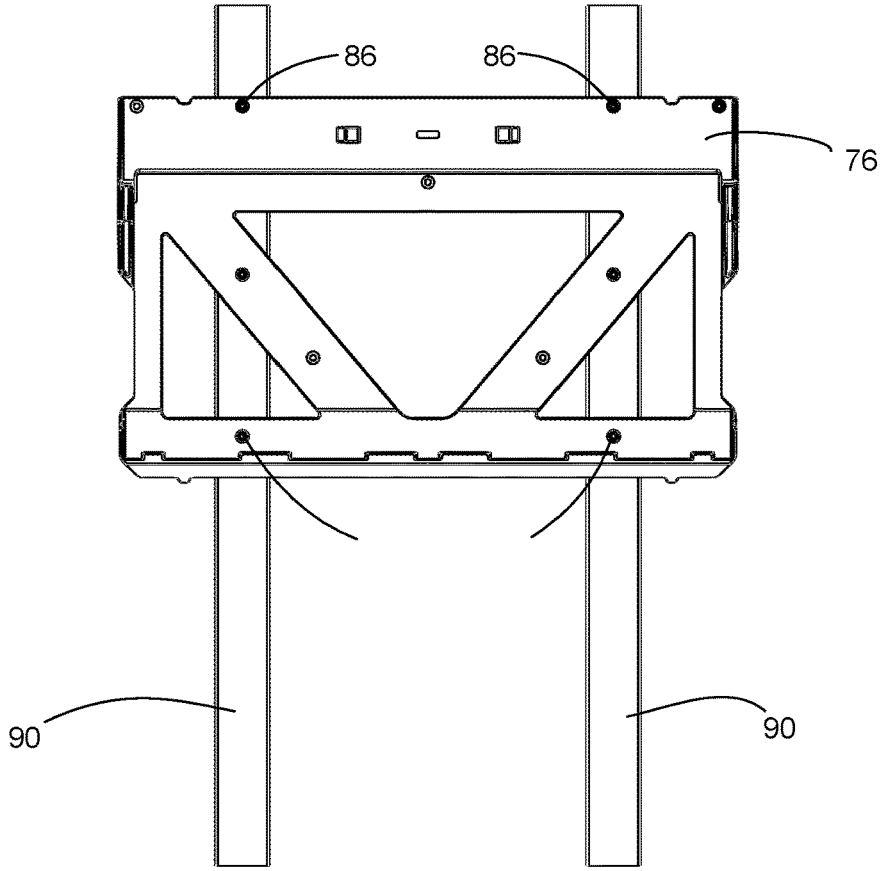
FIG. 49 is a front view showing the bracket attached to two studs.
Figure 50:
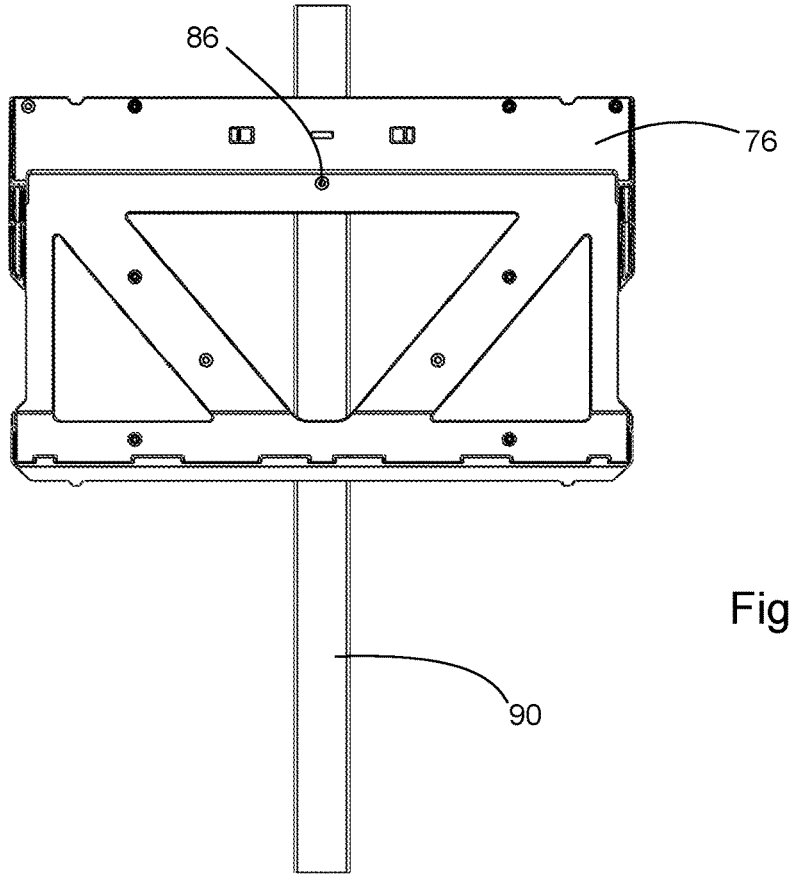
FIG. 50 is a front view showing the bracket attached to one stud.

Referring to FIGS. 40 and 41, the bracket 76 may comprise one or more fastener openings 86 adapted for receiving fasteners for securing the bracket 76 to one or more studs 90 in a wall. Referring to FIGS. 49 and 50, the fastener openings 86 may be arranged such that the bracket 76 may be attached a single one of the studs 90 (as shown in FIG. 50), the bracket 76 may span across two of the studs 90 (as shown in FIG. 49). A typical distance between two adjacent one of the studs 90 is approximately 16 inches; therefore, in some embodiments, at least some of the fastener openings 86 on the bracket 76 may be spaced approximately 16 inches apart.

Figure 7:
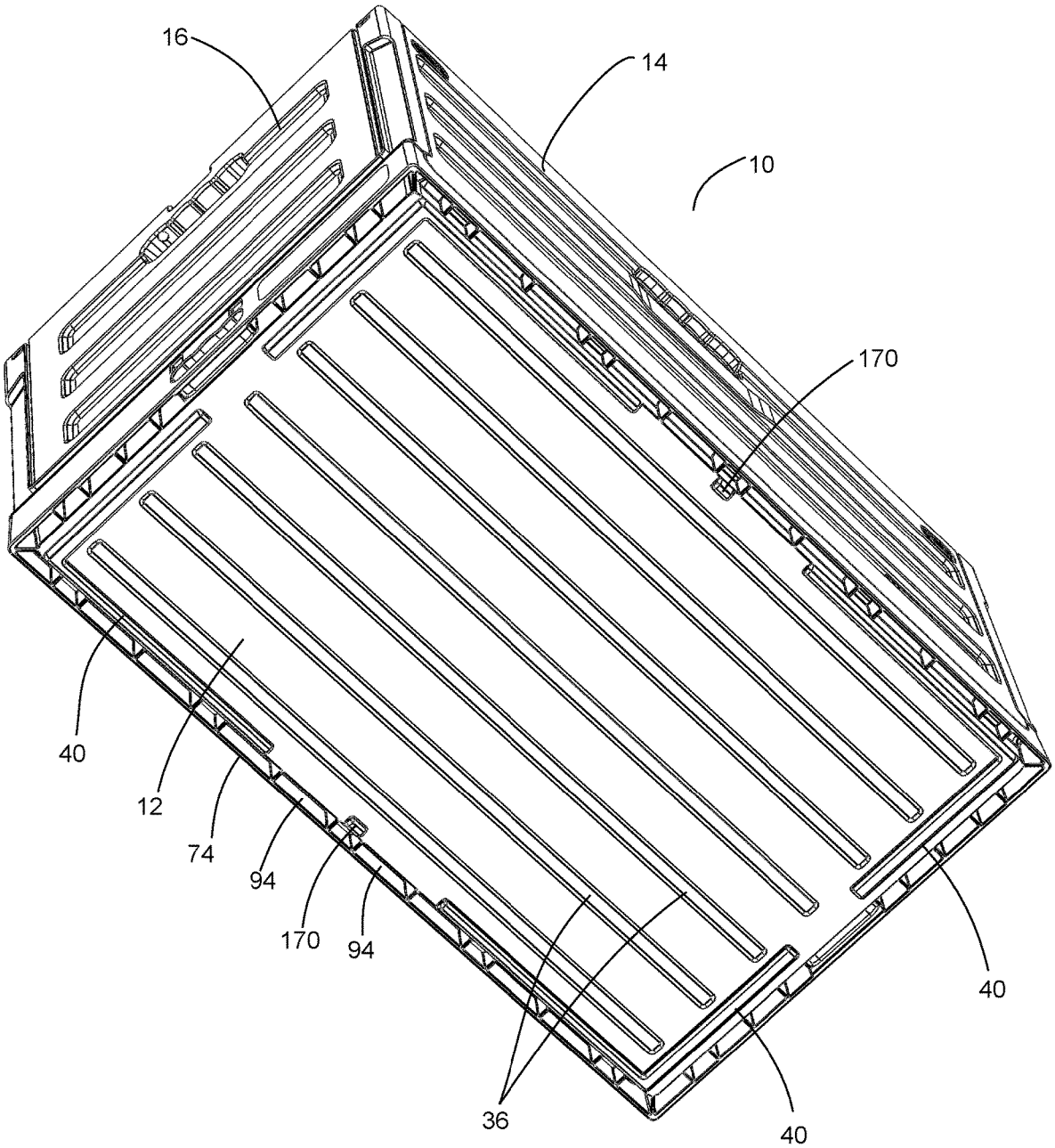
FIG. 7 is a bottom perspective view of the container with the lid removed.
Figure 44:
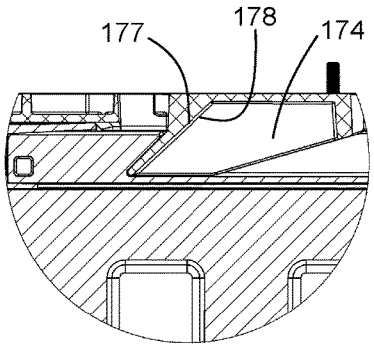
FIG. 44 is a magnified view of the portion Q of FIG. 43.
Figure 45:
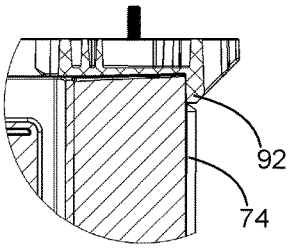
FIG. 45 is a magnified view of the portion R of FIG. 43.
Figure 42:
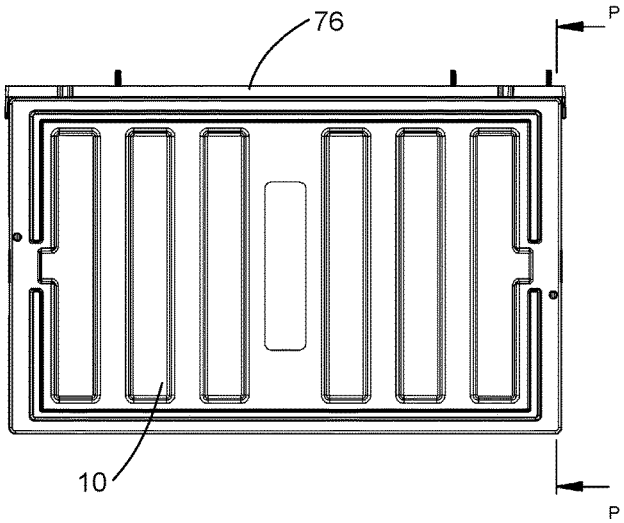
FIG. 42 is a top view of the container attached to the bracket.
Figure 43:
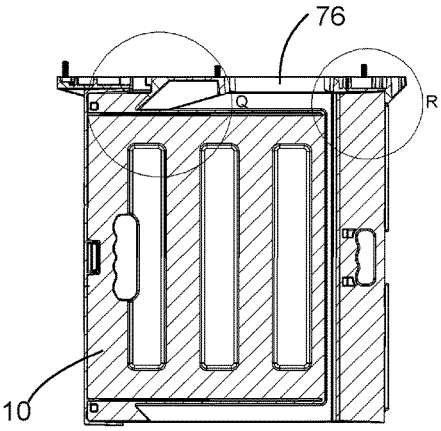
FIG. 43 is a cross-sectional view of FIG. 42 taken along P-P of FIG. 42.

The bracket 76 may comprise one or more upward-extending bracket protrusions 92 located proximate to the bracket lower edge 80. The bracket protrusions 92 are adapted to engage with the base 12, and in particular, with the base lower edge 74, as shown in FIGS. 42 to 48. Referring to FIG. 7, the base 12 may comprise a plurality of hollow regions 94 proximate to the base lower edge 74. The bracket protrusions 92 are adapted to fit within the hollow regions 94, thereby assisting in securing the container 10 to the bracket 76. FIG. 42 is a top view of the container 10 attached to the bracket 76. FIG. 43 is a cross-sectional view, taken along P-P of FIG. 42. FIG. 44 is a magnified view of the portion Q of FIG. 43, while FIG. 45 is a magnified view of the portion R of FIG. 43. When the container 10 is attached to the bracket 76, the container 10 is held in place through the engagement of the attachment members 174 with the slots 176 and through the engagement of the bracket protrusions 92 with the hollow regions 94.

Figure 46:
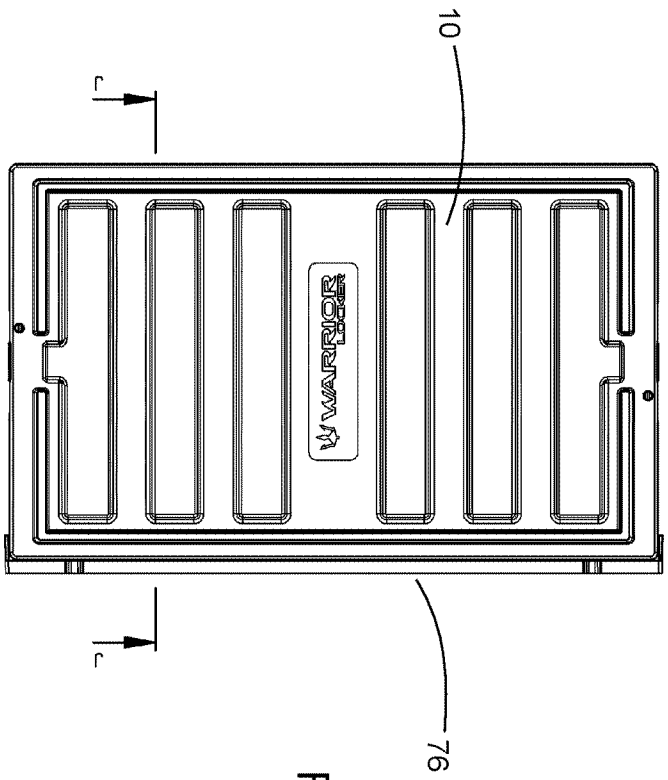
FIG. 46 is another top view of the container attached to the bracket.
Figure 47:
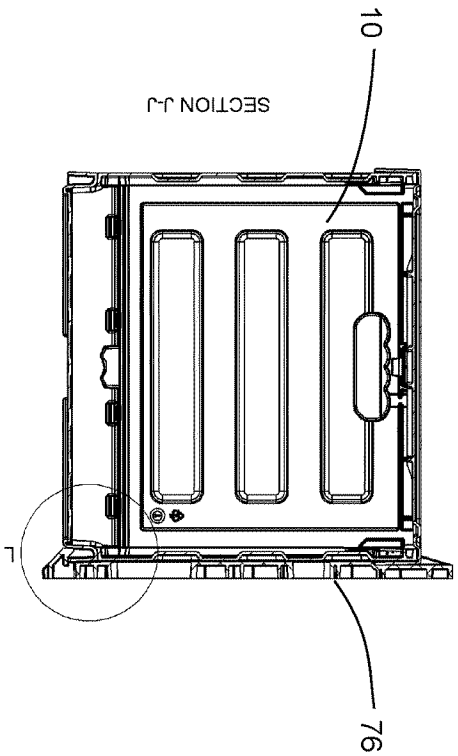
FIG. 47 is a cross-sectional view of FIG. 46 taken along J-J of FIG. 46.
Figure 48:
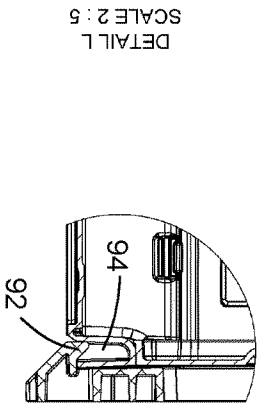
FIG. 48 is a magnified view of the portion L of FIG. 47.

FIG. 46 is another top view of the container attached to the bracket 76. FIG. 47 is a cross-sectional view, taken along J-J of FIG. 46. FIG. 48 is a magnified view of the portion L of FIG. 47. FIG. 48 depicts the engagement of the bracket protrusions 92 with the hollow regions 94.

Figure 51:
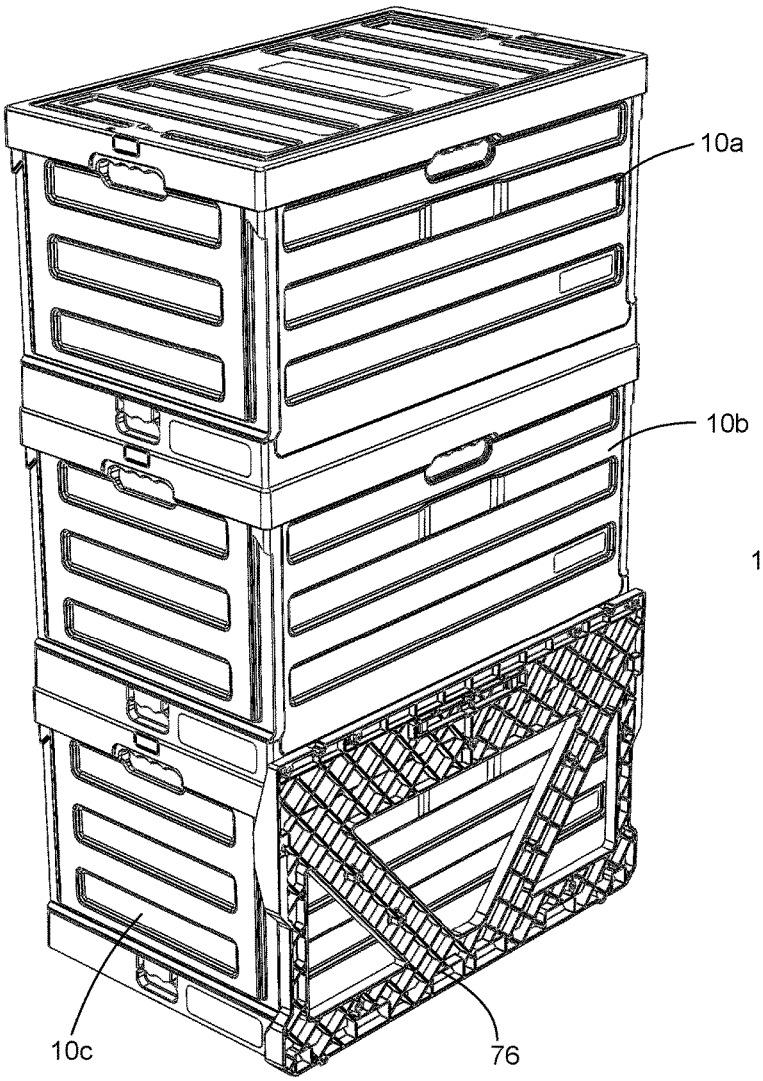
FIG. 51 shows three containers with the lowest one of the containers attached to the bracket.
Figure 52:
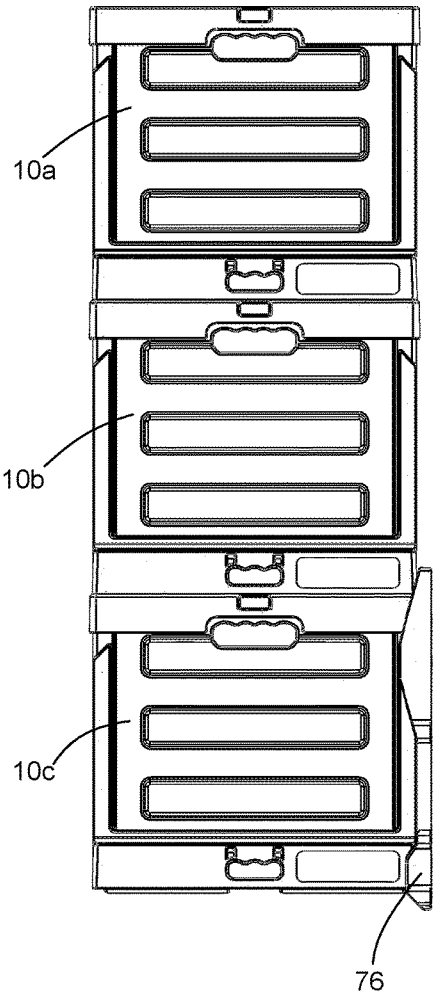
FIG. 52 is a side view of FIG. 51.

Referring to FIGS. 51 and 52, a number of containers 10*a*, 10*b*, 10*c* may be stacked on top of each (as described above), with the container 10*c* attached to the bracket 76 for securing to the wall. In this manner, a number of the containers 10 may be stacked together and elevated from the floor.

Referring to FIGS. 63 to 72, in some embodiments, the lid 18 may comprise one or more latch assemblies 102 that are configured to releasably engage the lid 18 with the first or second walls 14, 16. In such embodiments, the latch assemblies 102 are configured to releasably engage the lid 18 with the second walls 16, with one of the latch assemblies 102 configured to engage with each of the second walls 16.

The latch assembly 102 comprises a button assembly 106 and a housing 104 that is configured to house, at least in part, the button assembly 106. The housing 104 is located within the lid 18 and further comprises a housing end wall 105. The housing 104 comprises a first opening 108 that that is configured to allow the button assembly 106 to be inserted into the housing 104. The housing end wall 105 may be at an opposite end to the first opening 108. The housing 104 further comprises a second opening 110.

Figure 63:
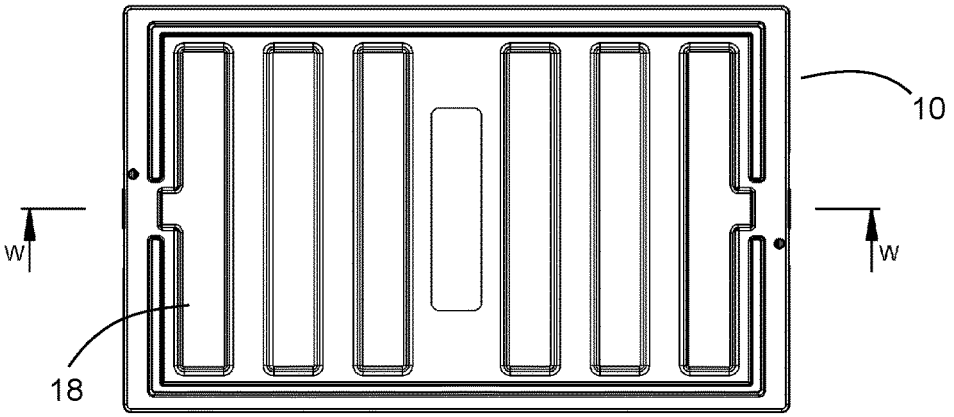
FIG. 63 is a top view of the container 10 with the lid attached.
Figure 64:
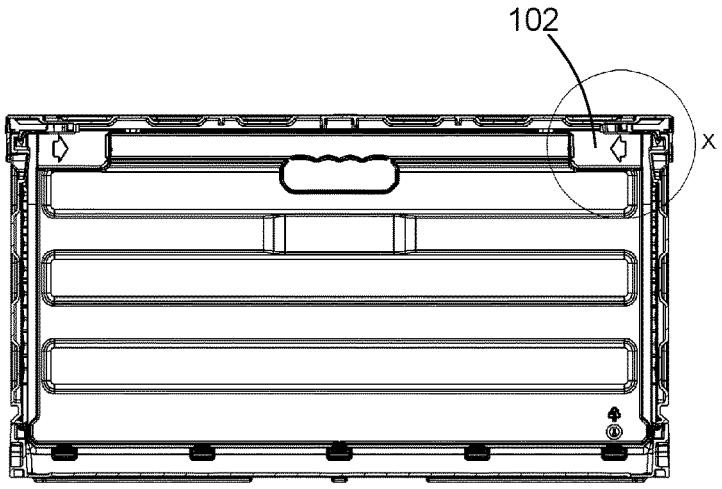
FIG. 64 is a cross-sectional view of FIG. 63 taken along W-W of FIG. 63.
Figure 65:
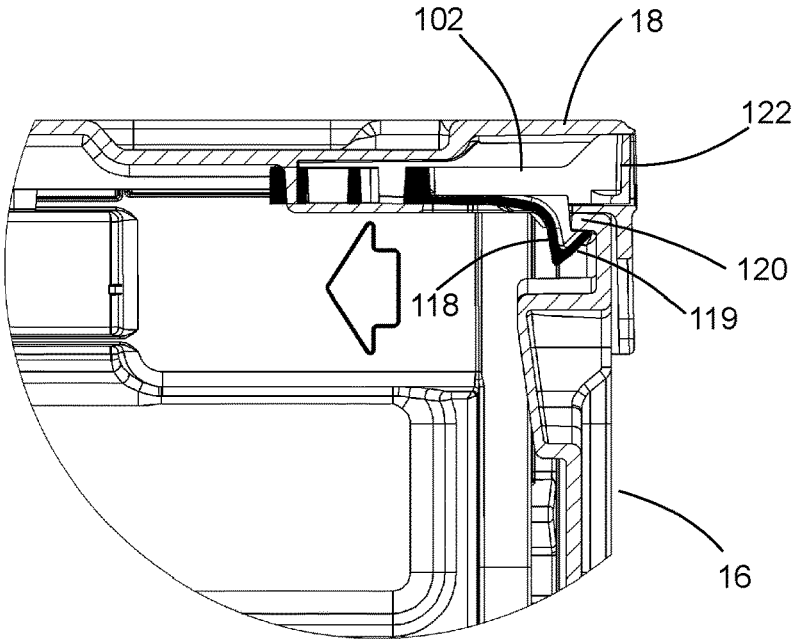
FIG. 65 is a magnified view of the portion X of FIG. 64.

FIG. 63 is a top view of the container 10, with the lid 18 attached. FIG. 64 is a cross-sectional view, taken along W-W of FIG. 63. FIG. 65 is a magnified view of the portion X of FIG. 64.

Figure 69:
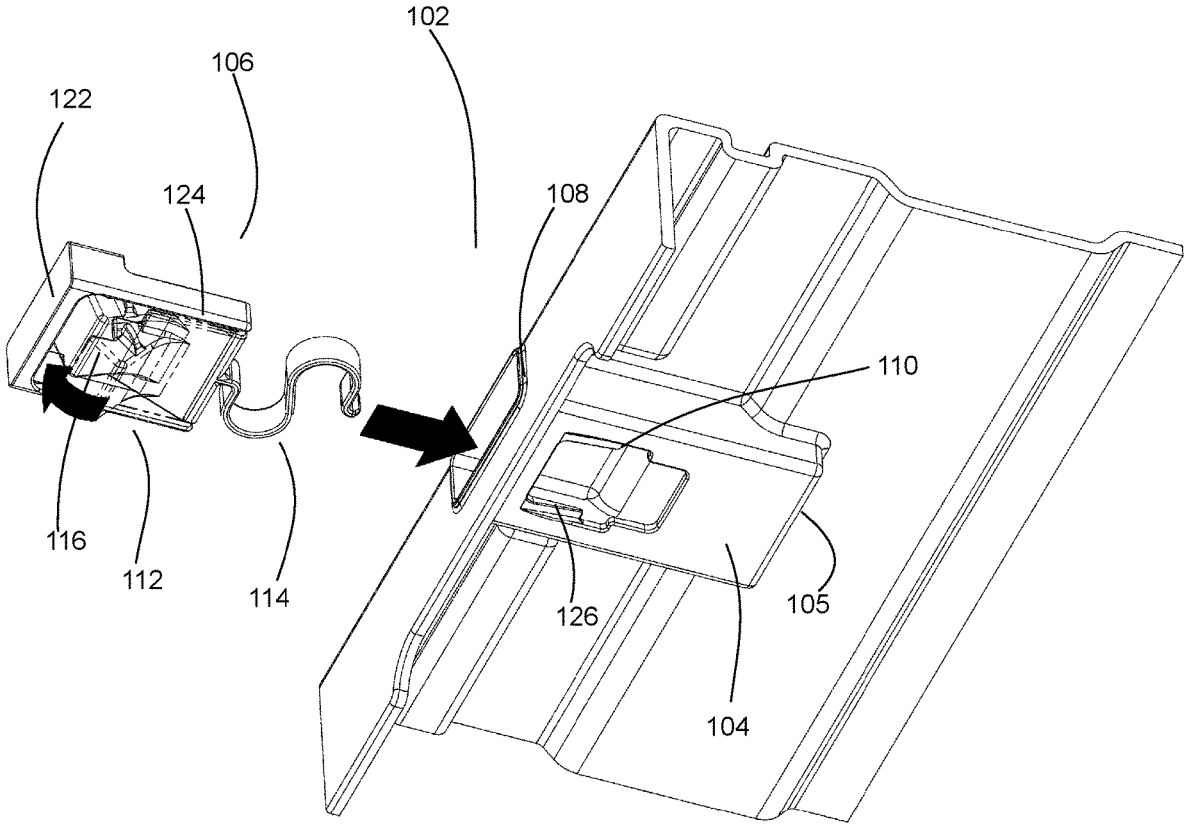
FIG. 69 shows the button assembly separate from the housing.

Referring to FIGS. 69 to 72, in some embodiments, the button assembly 106 may be inserted into the housing 104. FIG. 69 depicts the button assembly 106 separate from the housing 104. The button assembly 106 comprises a button body 112 and a spring 114 attached to the button body 112. The button assembly 106 further comprises a latching member 116 that is also attached to the button body 112 and is configured to flex. The latching member 116 may comprise first and second latching surfaces 118, 119 that are connected together. The button assembly 106 may further comprise a button wall 122.

Figure 70:
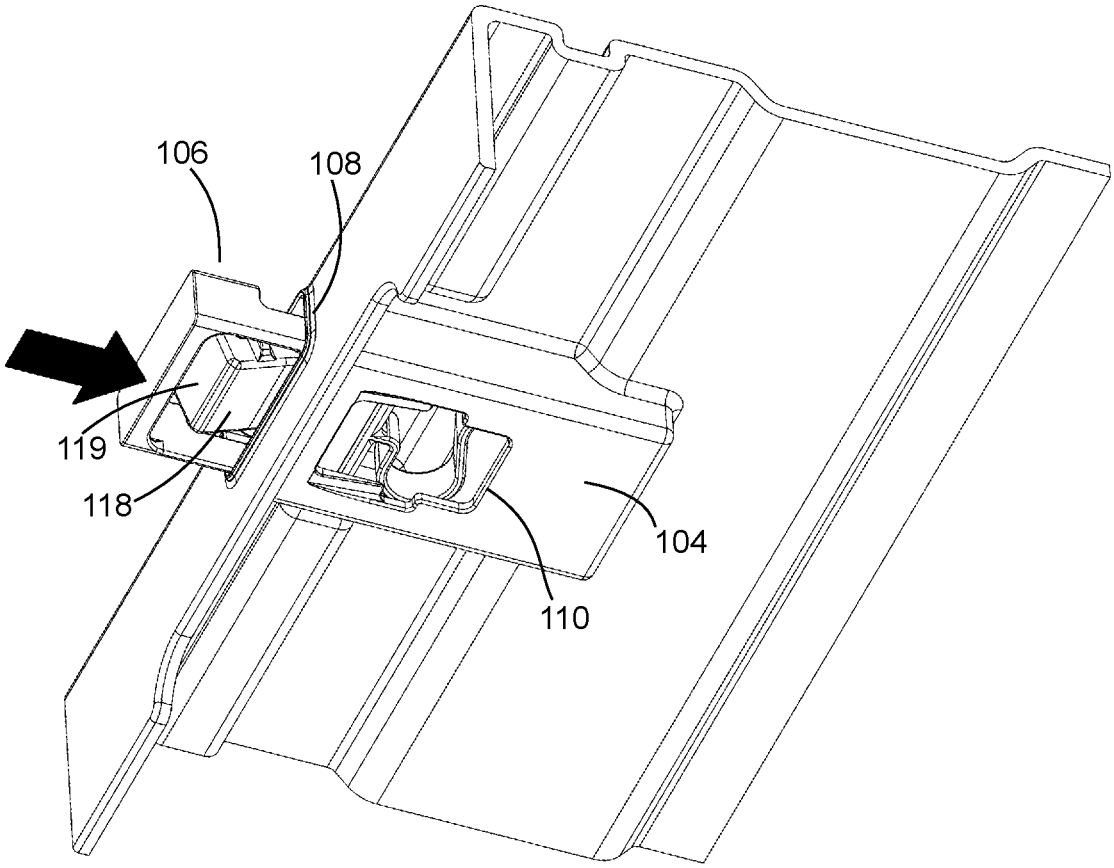
FIG. 70 shows the button assembly partially inserted into the housing.

FIG. 70 depicts the button assembly 106 partially inserted into the housing 104. As the button assembly 106 is inserted through the first opening 108, the latching member 116 (and in particular, the first latching surface 118) will come into contact with a periphery of the first opening 108. This contact will tend to cause the latching member 116 to flex upwards.

Figure 71:
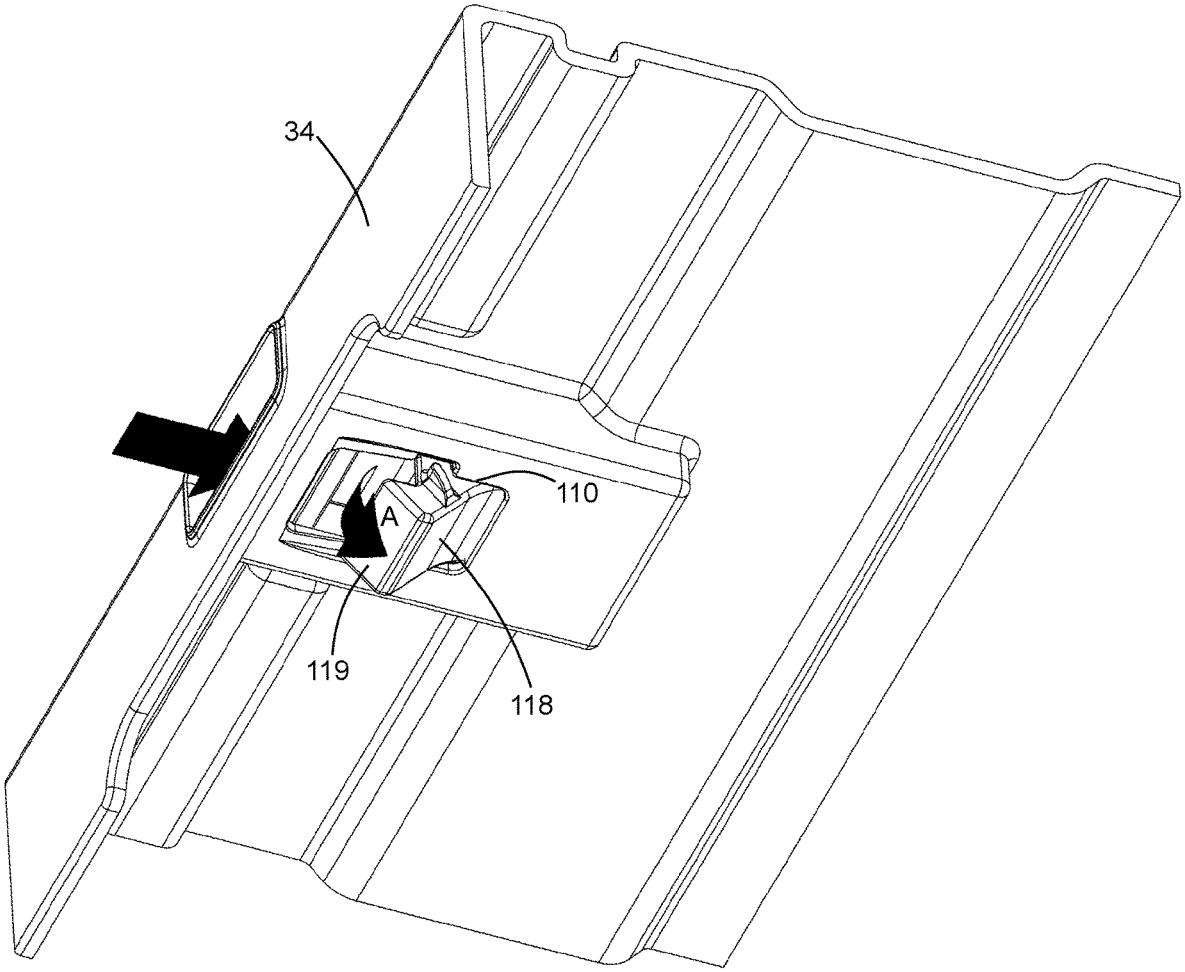
FIG. 71 shows the button assembly fully inserted into the housing.

FIG. 71 depicts the button assembly 106 fully inserted into the housing 104. In this configuration, the spring 114 may be in contact with the housing end wall 105 and may be at least partially compressed. As shown in FIG. 71, the button wall 122 may be inward of the lip 34. However, the latching member 116 (which was previously under stress from flexing) has substantially cleared past the second opening 110, which will allow the latching member 116 to revert back to its relaxed form, in direction A.

Figure 72:
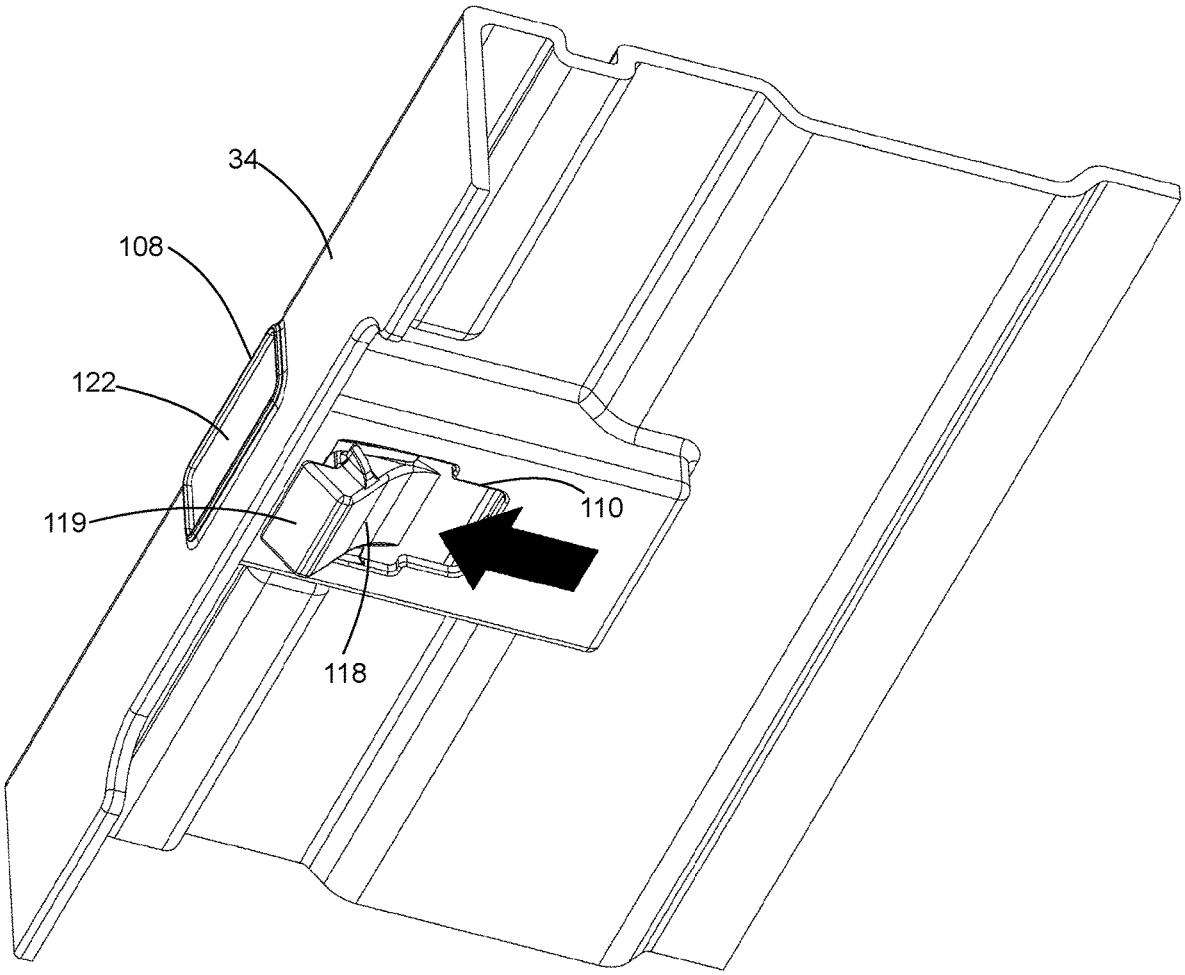
FIG. 72 shows the button assembly in the uncompressed state.

FIG. 72 depicts the button assembly 106 wherein the spring 114 is now in its uncompressed state. The button wall 122 is substantially flush with the lip 34. The button assembly 106 is held in place within the housing 104 by the engagement of the latching member 116 against a periphery of the second opening 110.

Figure 66:
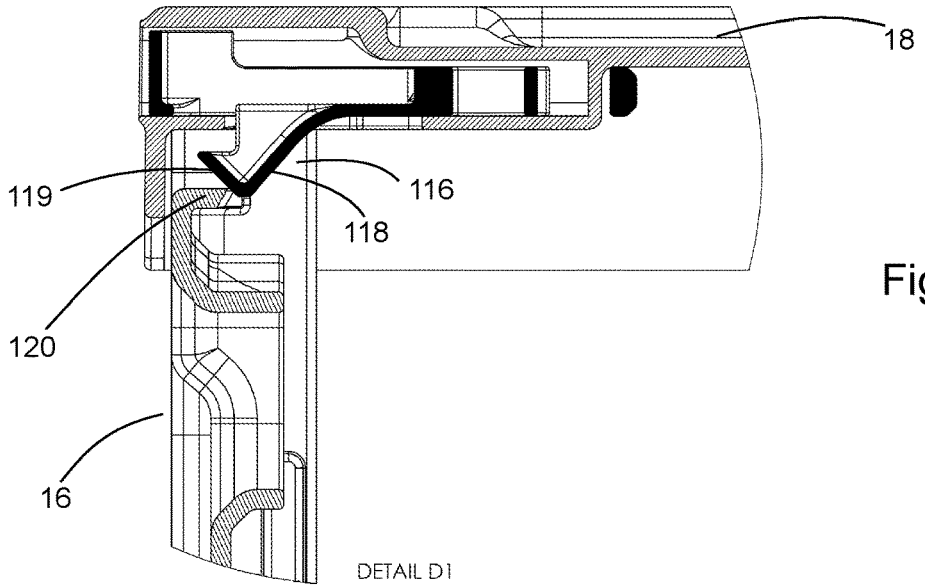
FIG. 66 is a cross-sectional view showing the lid disengaged with the container.
Figure 67:
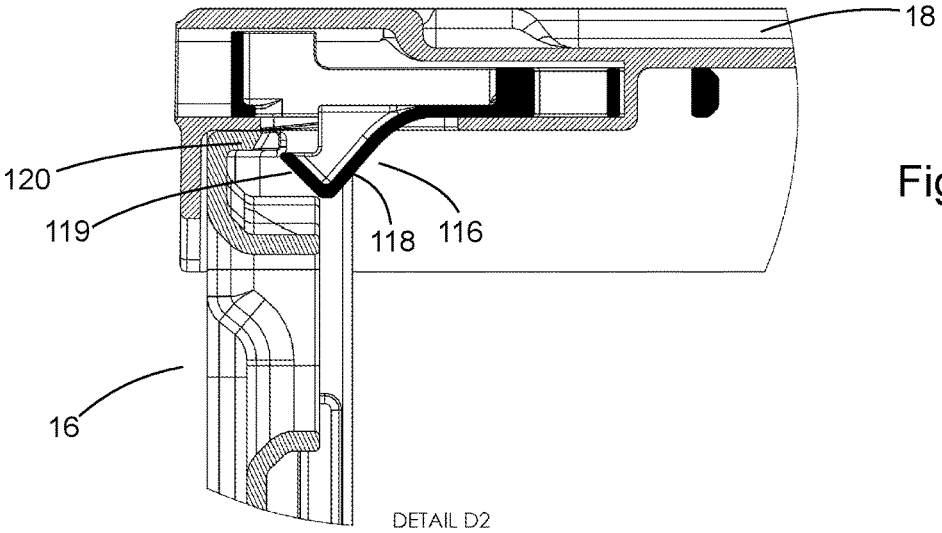
FIG. 67 is a cross-sectional view showing the lid partially engaged with the container.
Figure 68:
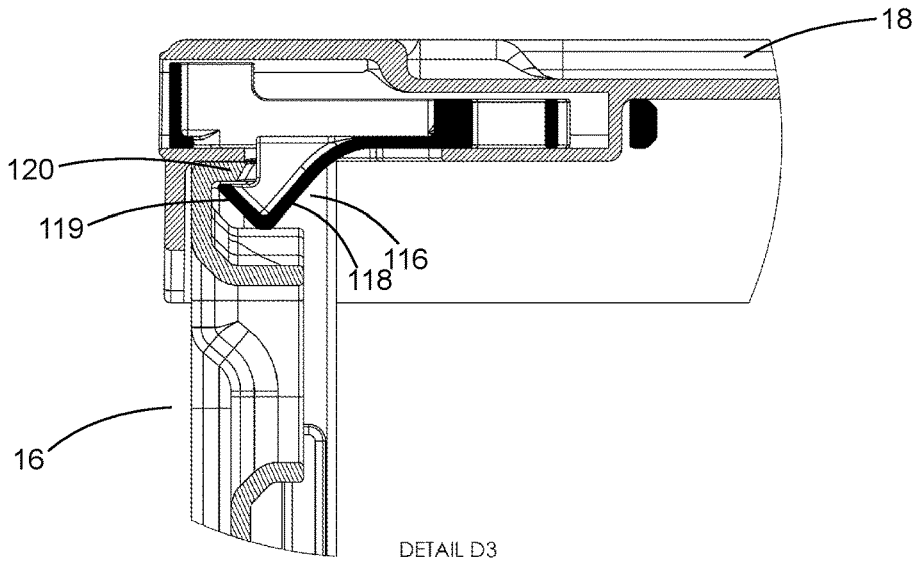
FIG. 68 is a cross-sectional view showing the lid engaged with the container.

FIGS. 66 to 68 are cross-sectional views showing the latch assembly 102 when the lid 18 is to be attached to the first and second walls 14, 16. When the lid 18 is to be attached to the first and second walls 14, 16, the lid 18 may be placed above the first and second walls 14, 16 such that the inclined surface 118 is resting on top of the second wall 16. In particular, the second wall 16 comprises a second wall ledge 120 proximate to the second wall upper edge 25. The inclined surface 118 may rest on the second wall ledge 120 (as shown in FIG. 66). When force is exerted downwards on the lid 18, this will cause the inclined surface 118 of the latching member 116 to flex as the inclined surface 118 pushes against the second wall ledge 120. Eventually, when sufficient force is exerted downwards on the lid 18, the inclined surface 118 will slide past the second wall ledge 120 (as shown in FIG. 67). Once it is past the second wall ledge 120, the inclined surface 118 will revert back to its original configuration, and the latching member 116 will now engage with the second wall ledge 120 (as shown in FIG. 68), thereby holding the lid 18 in place.

Figure 78:
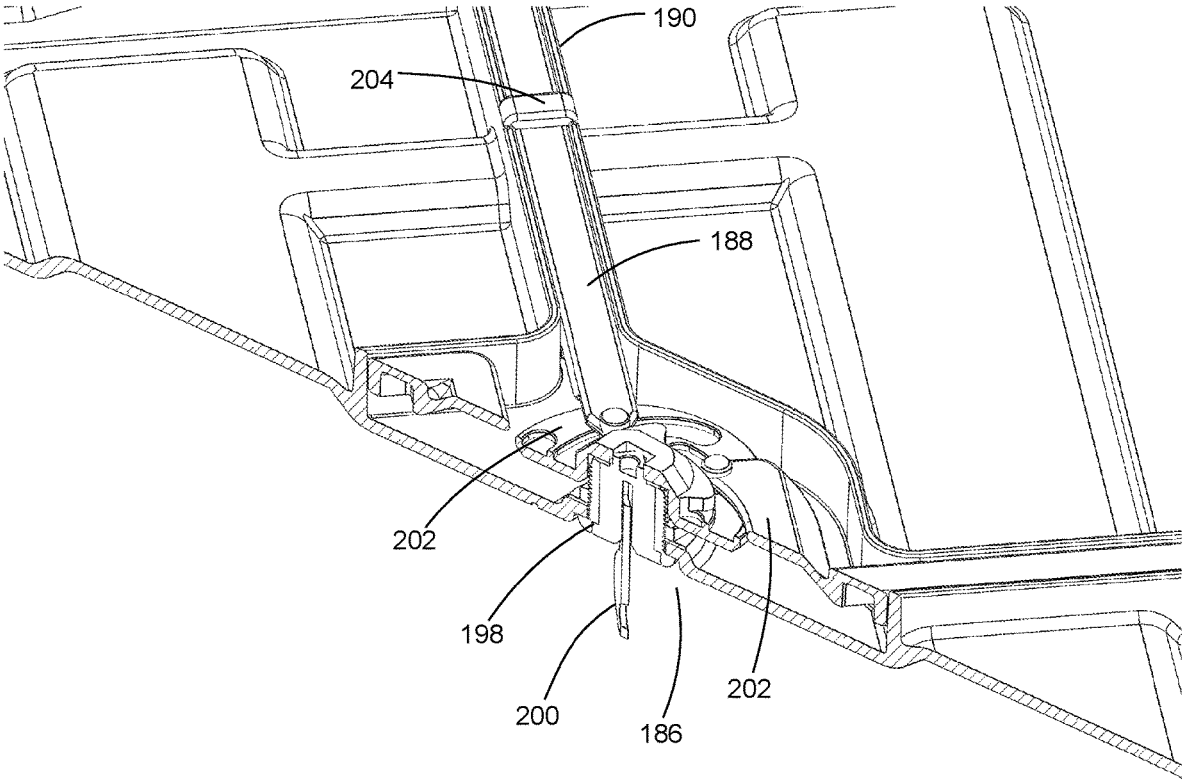
FIG. 78 is a cross-sectional view of the lock assembly.
Figure 79:
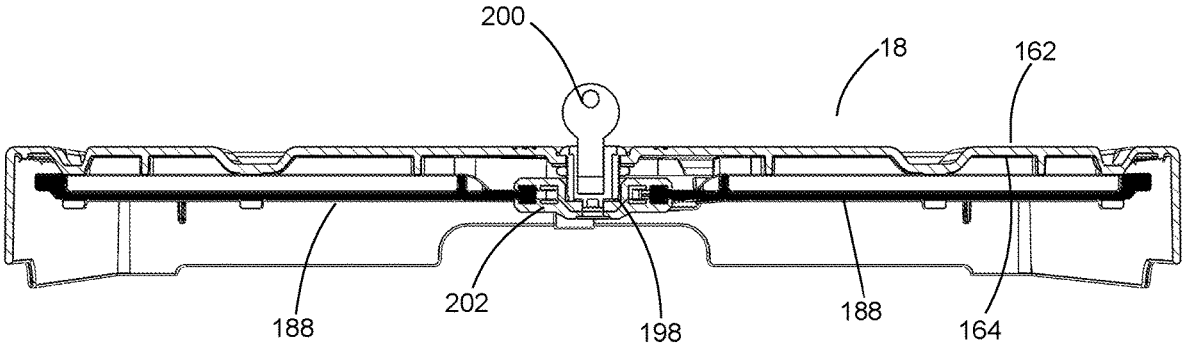
FIG. 79 is another cross-sectional view of the lock assembly.
Figure 80:
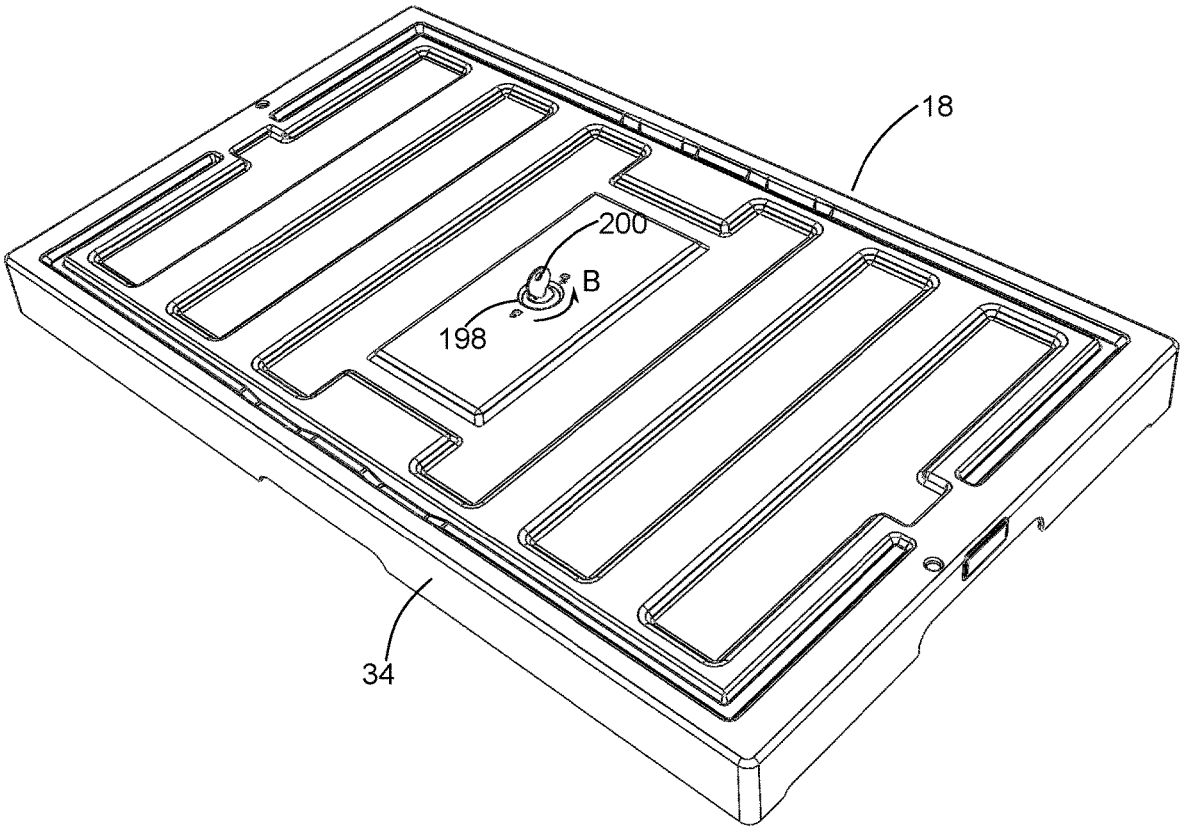
FIG. 80 is a perspective view of the lid with the lock assembly.

The process by which the lid 18 is to be removed from the first and second walls 14, 16 may also be depicted by FIGS. 78 to 80, though in reverse.

When the lid 18 is attached to the first and second walls 14, 16 (i.e. when the container 10 is in the upright configuration), the latching member 116 engages with the second wall ledge 120. The button wall 122 may be substantially flush with the lip 34 when the lid 18 is attached to the first and second walls 14, 16.

When the button body 112 is pushed inwardly through the first opening 108 (such as by pressing on the button wall 122), the spring 114 is forced to compress. As the button body 112 is pushed further inward, the latching member 116 slides past the second wall ledge 120 and is no longer engaged with the second wall ledge 120. The lid 18 is no longer held in place and can be removed away from the first and second walls 14, 16. When the button wall 122 is released (i.e. when force is no longer applied on the button wall 122), the spring 114 is able to revert back to its original configuration, moving the button body 112 back outwards.

In this manner, the lid 18 may be removably attached and detached using the latch assemblies 102. In particular, removal of the lid 18 will involve pushing the button walls 122 inwards; however, attachment of the lid 18 does not require pushing inwards of the button walls 122. Attachment of the lid 18 requires a downward exert of the force of the lid 18 against the second walls 16.

In some embodiments, referring to FIG. 69, the second wall ledge 120 may comprise a chamfer that may help avoid the latching member 116 from being stuck. In addition, the latching member 116 may comprises tabs 124 on its lateral sides. The tabs 124 are configured to engage with tab notches 126 formed on the second opening 110 when the latching member 116 is in its normal (un-flexed) configuration.

Figure 73:
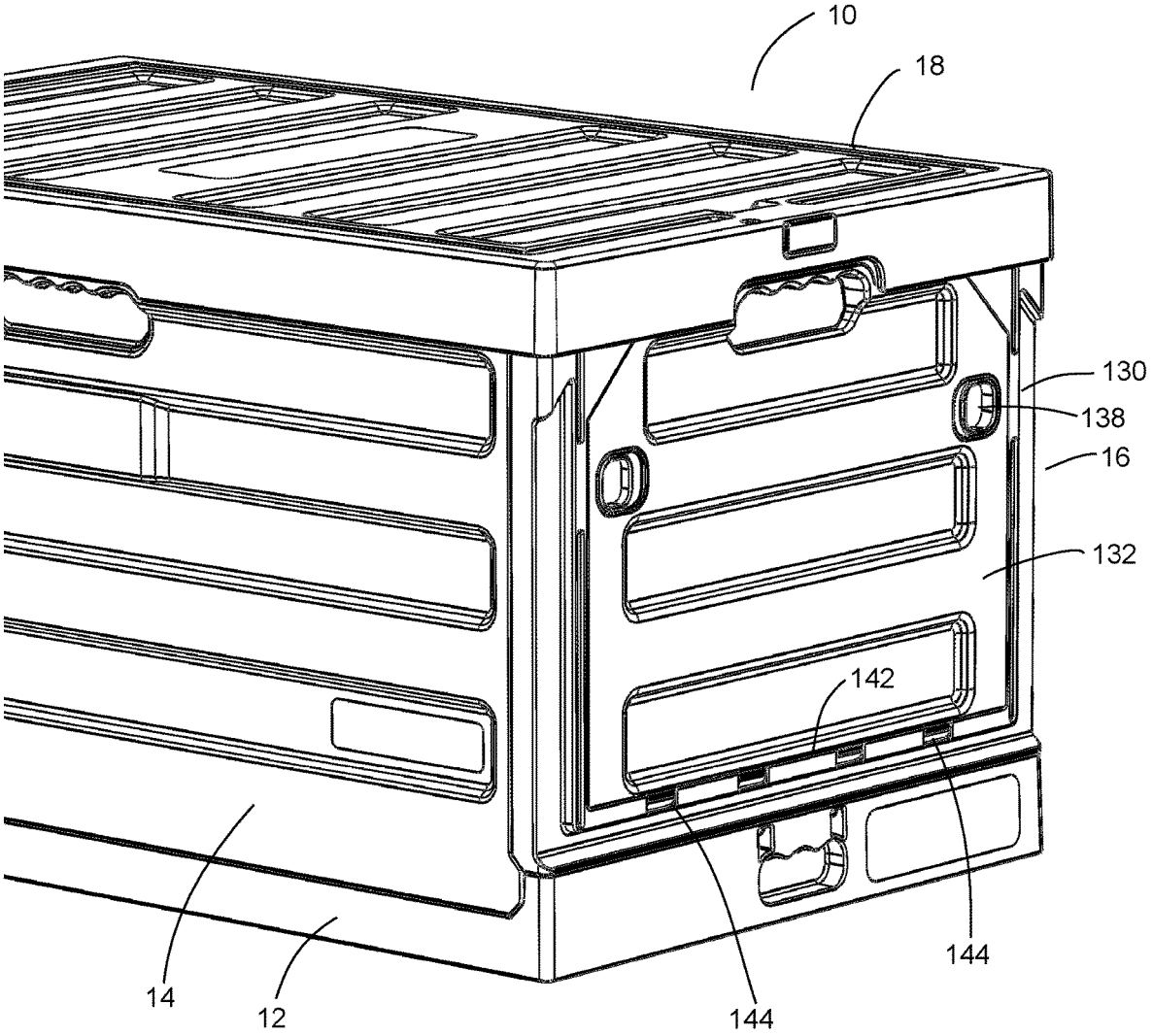
FIG. 73 shows the container in accordance with another embodiment.
Figure 74:
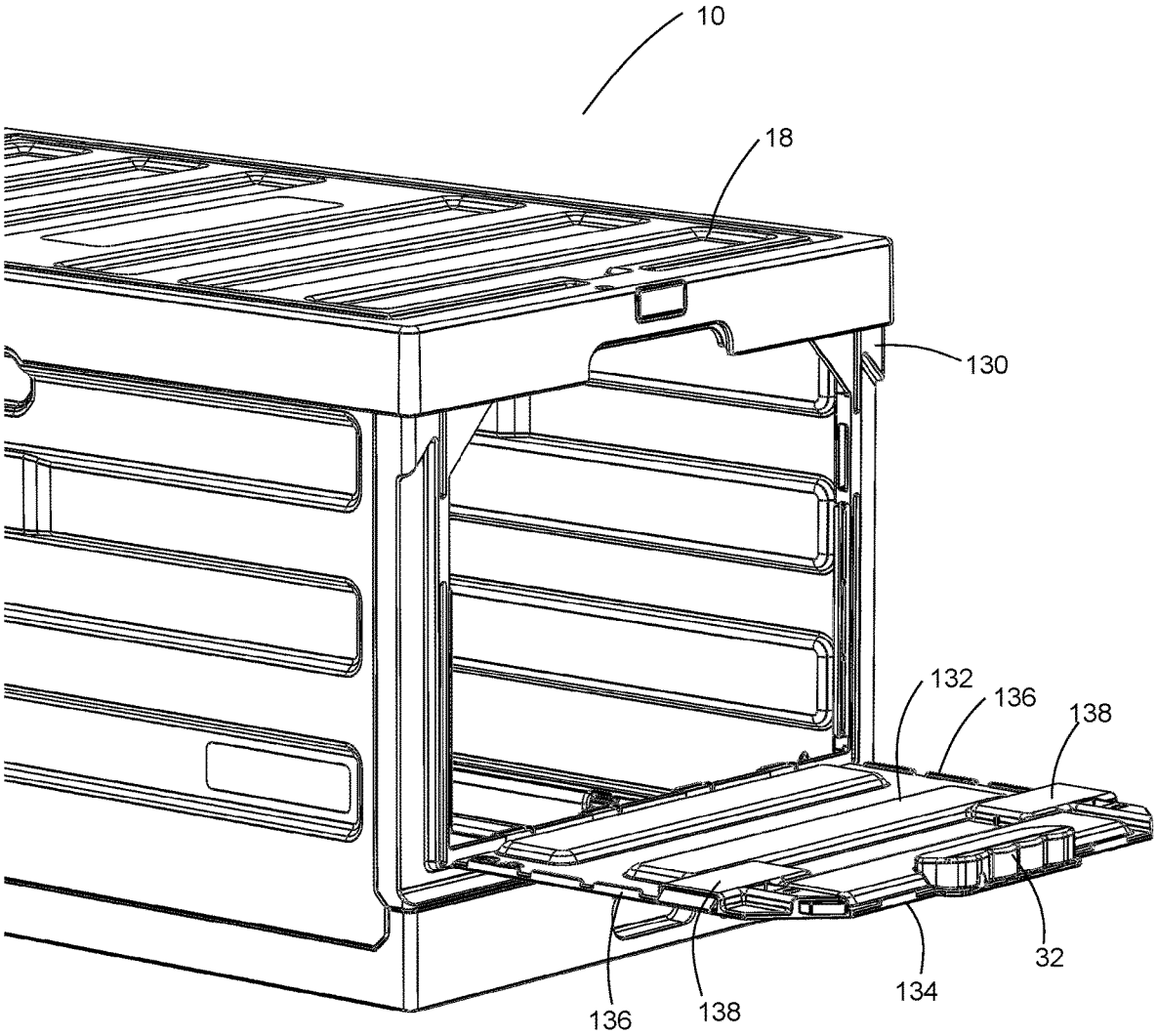
FIG. 74 shows the container of FIG. 73 with the side door folded down.
Figure 75:
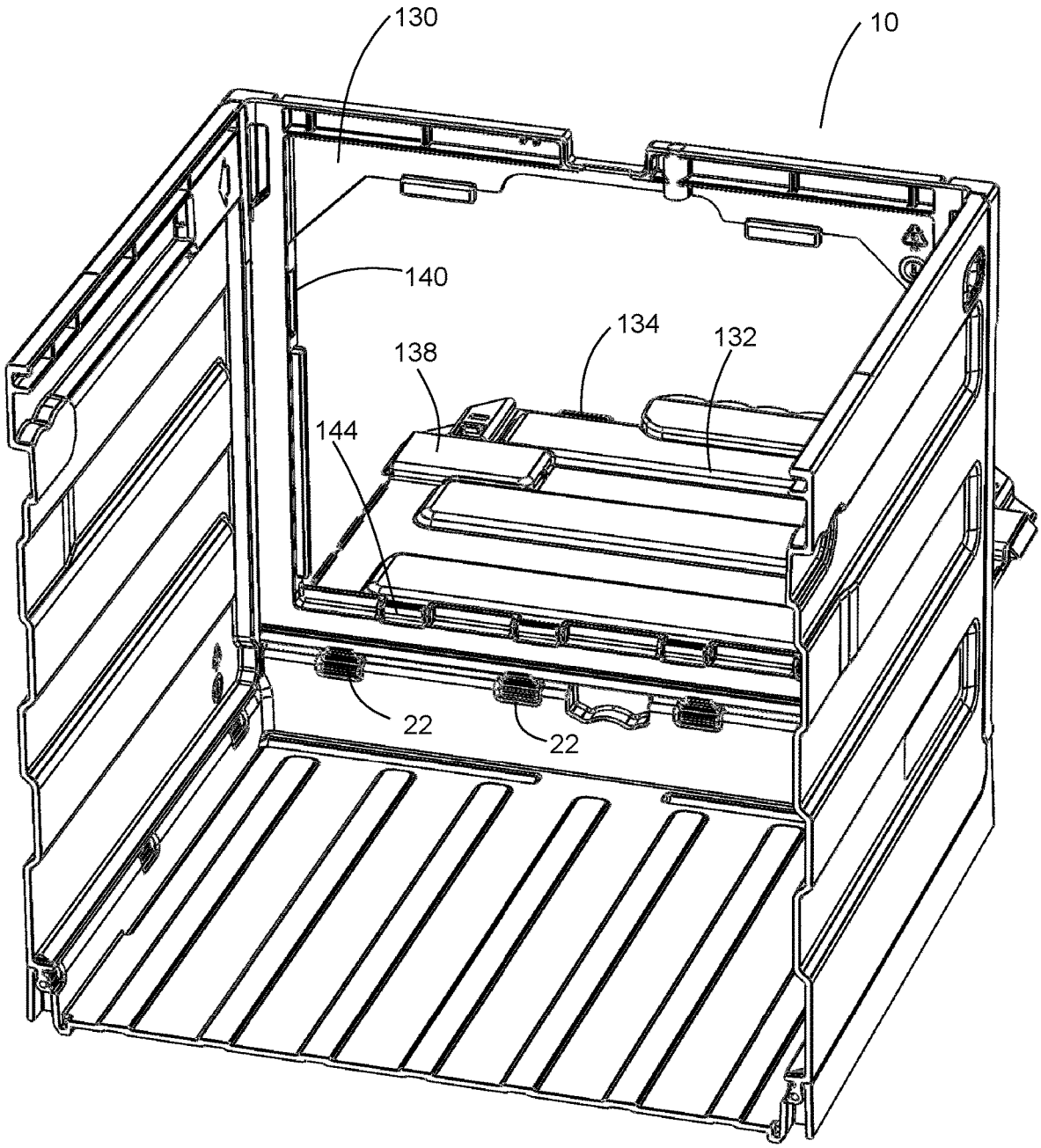
FIG. 75 is a cross-sectional view of FIG. 74.

Referring to FIGS. 73 to 75, in some embodiments, one or both of the second walls 16 may comprise a frame 130 surrounding, at least in part, a side door 132. The side door 132 comprises an upper door edge 134, a lower door edge 142, and lateral door edges 136. For example, in the embodiment shown in FIGS. 73 to 75, the frame 130 may extend along at least an upper door edge 134, two lateral door edges 136, and a lower door edge 142 of the side door 132. The frame 130 comprises a frame hinge member 144 to which the side door 132 may be attached (as best shown in FIG. 75). The side door 132 may be attached to the frame hinge member 144 proximate to the lower door edge 142.

The side door 132 may be attached to the frame hinge member 144 such that the side door 132 is able to hingedly move outwards (with respect to the frame 130). The side door 132 may be able to hingedly move outwards to a maximum of approximately 90°.

In some embodiments, the handholds 32 may be part of the side door 132.

The side door 132 may comprise one or more door latch mechanisms 138 located proximate to the lateral door edges 136 that are configured to engage with frame latches 140 located on the frame 130. The door latch member 138 and the frame latches 140 allow the side door 132 to be releasably secured to the frame 130. When the side door 132 is secured to the frame 130, the side door 132 and the frame 130 are able to act as a unitary member. The door latch members 138 may also be located proximate to the upper door edge 134.

When one of the containers 10 is stacked on top of another one of the containers 10, the side door 132 of one of the container 10 may be releasably opened outwards in order to allow for access to an interior of the container 10, without having to unstack the containers 10.

The lid 18 acts to hold the frame 130 in place with respect to the first walls 14, even when the side door 132 is released and opened outwards.

In some embodiments, the lid 18 may be secured to the first and second walls 14, 16 when the container 10 is in the upright configuration. In one embodiment, referring to FIGS. 1 and 6, the lid 18 may comprise one or more lid openings 180. Corresponding ones of the second wall openings 182 may be located on the second wall ledge 120, such that when the lid 18 is attached to the first and second walls 14, 16, the lid openings 180 are substantially aligned with the second wall openings 182. A cable tie may be inserted through the lid openings 180 and the second wall openings 182 in order to secure the lid 18 to the second walls 16.

Figure 76:
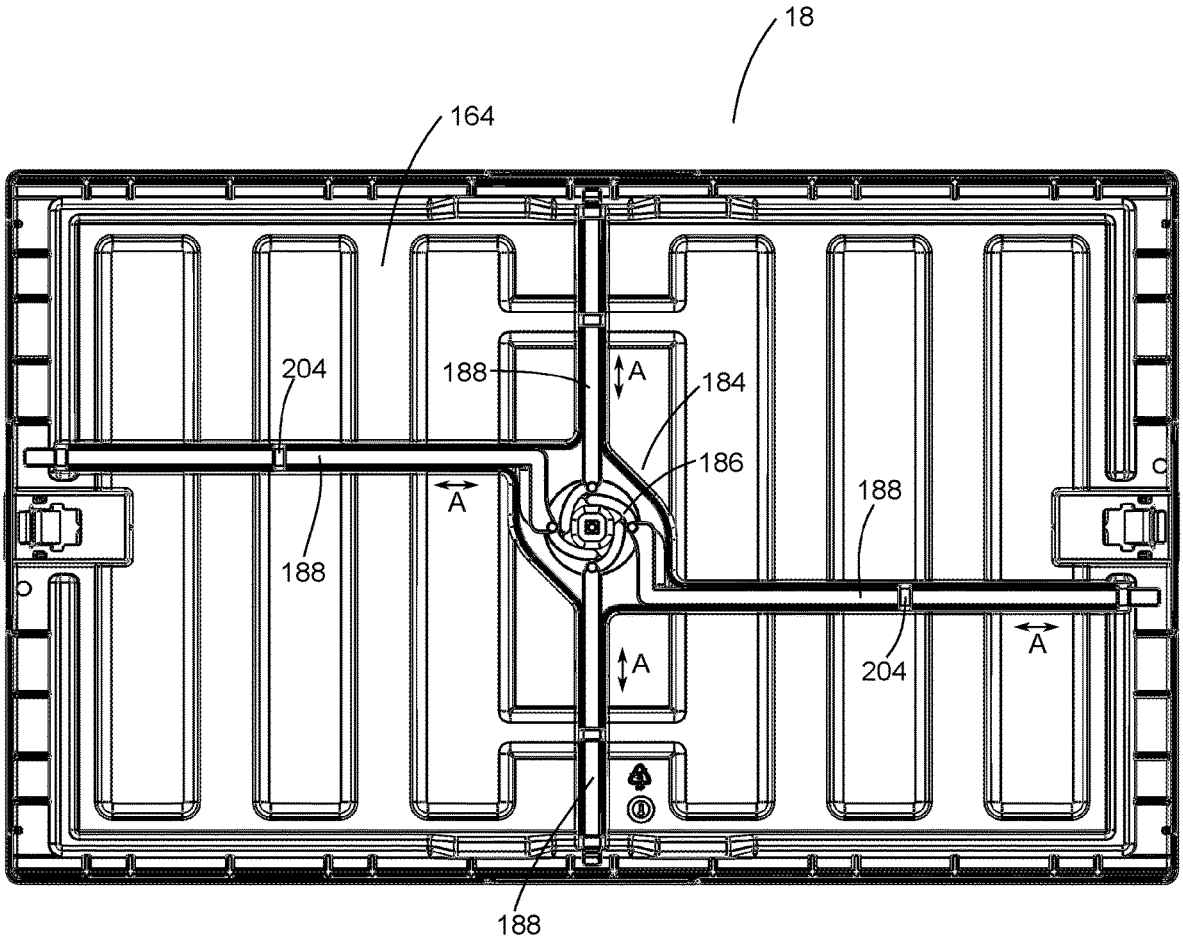
FIG. 76 shows the lock assembly in the locked configuration.
Figure 77:
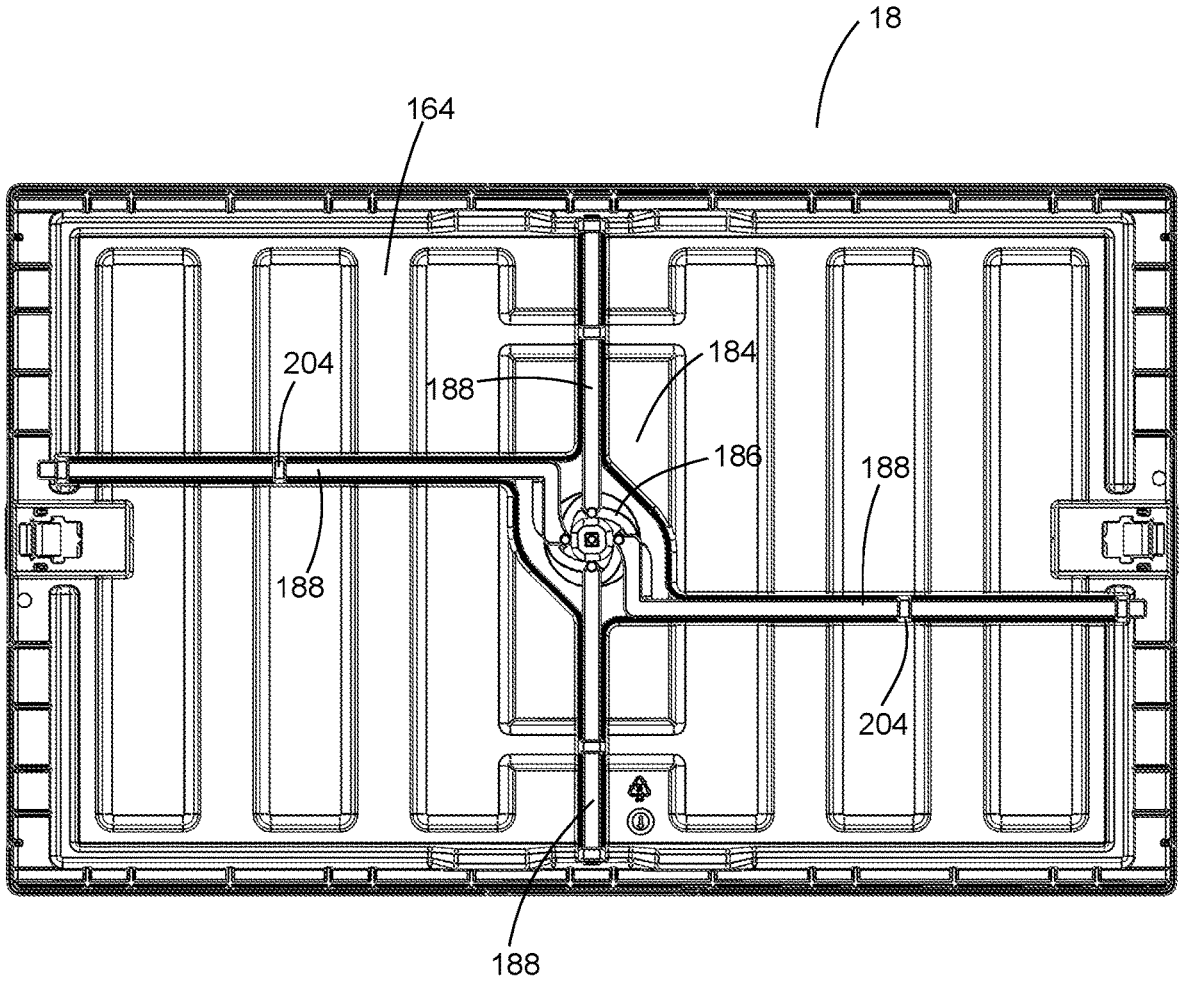
FIG. 77 shows the lock assembly in the unlocked configuration.

Referring to FIGS. 76 to 82, in other embodiments, the lid 18 may comprise a lock assembly 184 for securing the lid 18 to the first and second walls 14, 16 when the container is in the upright configuration. The lock assembly 184 may be located on the lower lid surface 164 and comprises a central lock 186 and a plurality of arms 188 extending from the central lock 186. The lid 18 may comprise a plurality of channels 190 that are configured to enclose, at least partially, the arms 188 and to allow for movement of the arms 188 within the channels 190 in a longitudinal direction. For example, FIGS. 76 and 77 depict an underside of the lid 18 (i.e. the lower lid surface 164). FIG. 76 depicts the lock assembly 184 in the locked configuration, while FIG. 77 depicts the lock assembly 184 in the unlocked configuration.

Figure 81:
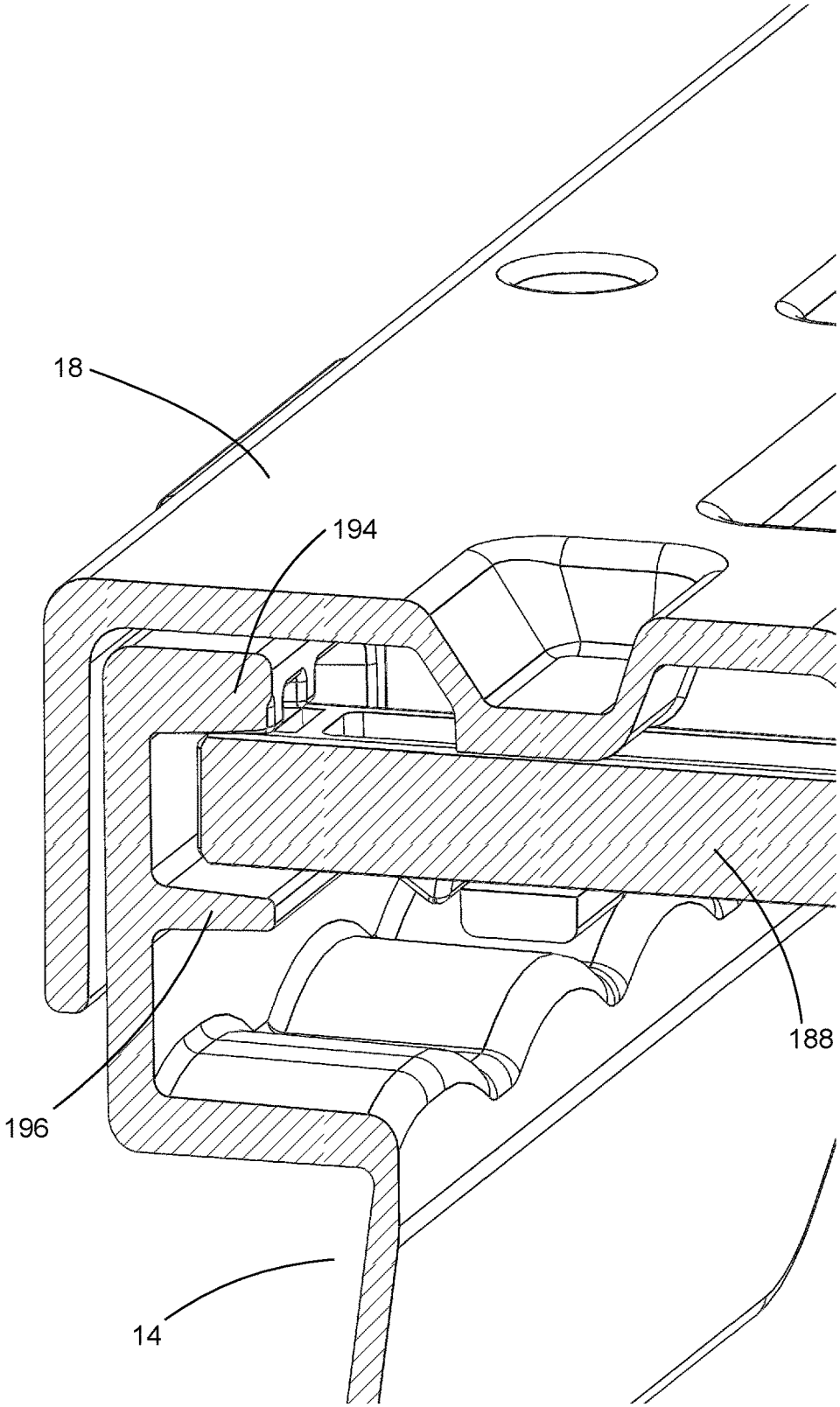
FIG. 81 is a cross-sectional view showing the engagement of one of the arms with the first wall.
Figure 82:
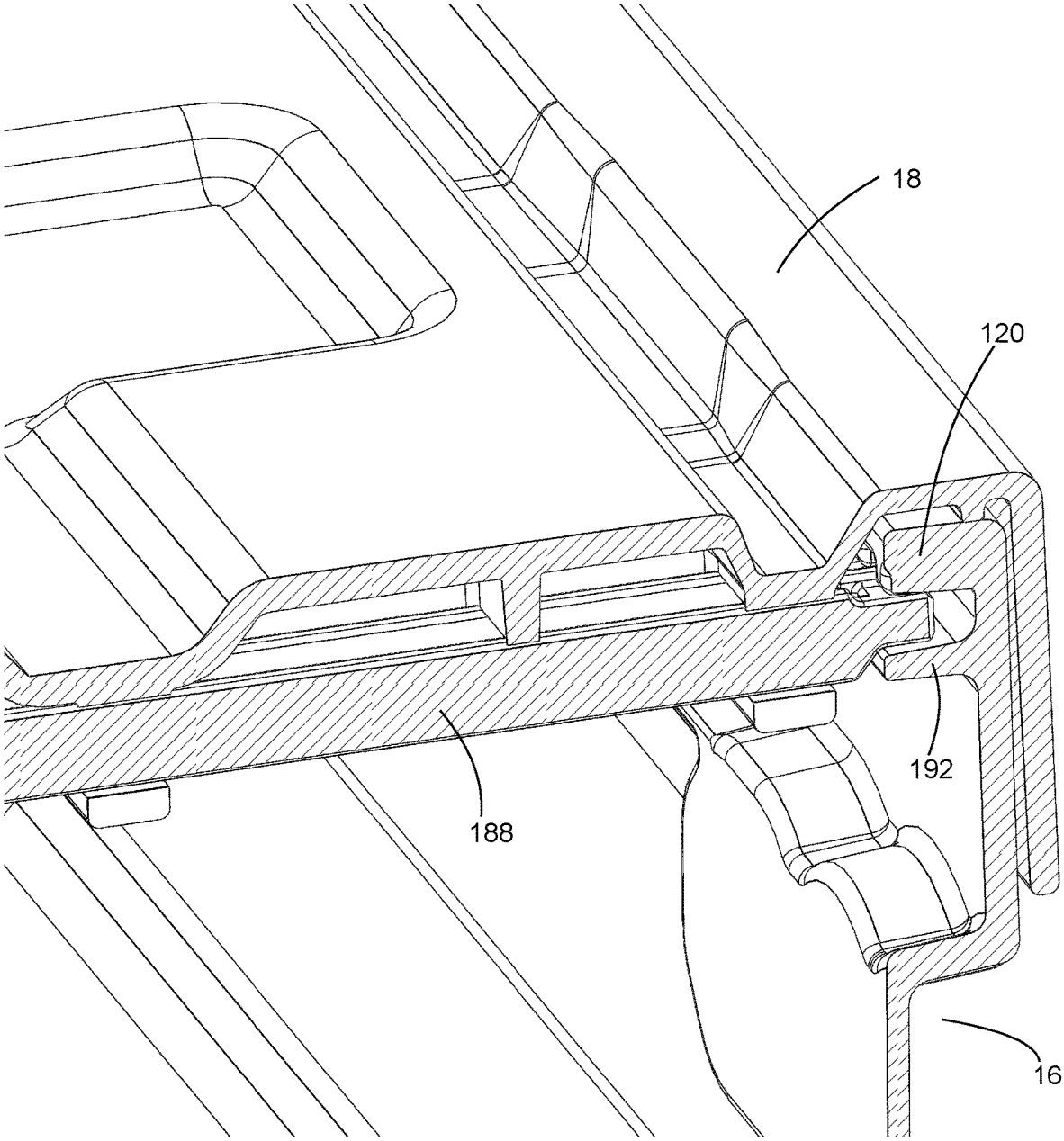
FIG. 82 is a cross-sectional view showing the engagement of the arms with the second wall.

Referring to FIGS. 81 and 82, the second walls 16 comprise one or more second wall members 192 that are spaced apart from the second wall ledge 120 and are substantially parallel to the second wall ledge 120. The first walls 14 comprise a first wall ledge 194 proximate to the first wall upper edge 23. The first walls 14 further comprise one or more first wall members 196 that are spaced apart from the first wall ledge 194 and are substantially parallel to the first wall ledge 194.

Referring to FIGS. 81 and 82, the arms 188 are configured to move into and between the second wall ledge 120 and the second wall members 192 and move into and between the first wall ledge 194 and the first wall members 196. When the arms 188 are between the second wall ledge 120 and the second wall members 192 and between the first wall ledge 194 and the first wall members 196, the lid 18 is held in place (and thus locked) to the first and second walls 14, 16. When the arms 188 are retracted out from between the second wall ledge 120 and the second wall members 192 and out from between the first wall ledge 194 and the first wall members 196, the lid 18 is no longer held in place (and thus unlocked) to the first and second walls 14, 16.

Movement of the arms 188 is effected by the central lock 186. The central lock 186 comprise a key mechanism 198 that is configured to accept a key 200. When the key 200 is inserted into the key mechanism 198, the key mechanism 198 allows for rotation of the key 200. The central lock 186 comprises a plurality of curved members 202 connected to the arms 188 that are configured to translate rotational movement (of the key 200 within the key mechanism 198, such as in direction B in FIG. 80) into linear movement of the arms 188 within the channels 190 (e.g. in directions A, as shown in FIG. 76).

By rotating the key 200 within the key mechanism 198, the arms 188 may be moved into the first and second walls 14, 16 (to lock the lid 18 in place to the first and second walls 14, 16) or moved out of the first and second walls 14, 16 (to release the lid 18 from the first and second walls 14, 16).

The lid 18 may comprise one or more collars 204 extending across the channels 190. The collars 204 may act to ensure that the arms 188 remain within the channels 190 when moving.

It will be appreciated by those skilled in the art that the preferred embodiment has been described in some detail but that certain modifications may be practiced without departing from the principles of the present disclosure.

The invention claimed is:

1. A foldable container comprising:
- a base;
- a pair of opposed first walls extending from the base;
- a pair of opposed second walls extending from the base, each of the second walls comprising:
  - a second wall upper edge; and
  - a second wall ledge extending inwardly proximate to the second wall upper edge;
  - wherein each of the first and second walls is configured to hingedly rotate with respect to the base between an upright position and a collapsed position; and
- a lid configured to removably attach to the second walls while the second walls are in the upright position, wherein the lid comprises one or more latch assemblies, each of the latch assemblies comprising:
  - a housing comprising first and second openings; and
  - a button assembly configured to move within the housing, the button assembly comprising:
    - a button body;
    - a latching member connected to the button body and configured to pass through the second opening and further configured to engage with the second wall ledge to attach the lid to the second wall; and
    - a spring connected to the button body and configured to engage with the housing;

wherein compression of the button body against the spring effects disengagement of the latching member from the second wall ledge to remove the lid from the second wall.

2. The foldable container of claim 1, wherein the one or more latch assemblies comprises two latch assemblies.

3. The foldable container of claim 1, wherein each of the first walls comprises:

a first wall upper edge;

a first wall ledge extending inwardly proximate to the first wall upper edge; and a first wall member extending inwardly and spaced apart from the first wall ledge.

4. The foldable container of claim 3, wherein each of the second walls further comprises a second wall member extending inwardly and spaced apart from the second wall ledge.

5. The foldable container of claim 4, wherein the lid further comprise a lock assembly for locking the lid to the first and second walls while the first and second walls are in the upright position, the lock assembly comprising:

a central lock configured to accept rotational movement by a key; and a plurality of arms extending from and connected to the central lock, the arms configured to move laterally in between the first wall ledge and the first wall member or in between the second wall ledge and the second wall member to lock the lid to the first and second walls, or to move laterally out from between the first wall ledge and the first wall member or out from between the second wall ledge and the second wall member to unlock the lid to the first and second walls;

wherein the central lock is further configured to translate the rotational movement of the key into lateral movement of the arms.

6. The foldable container of claim 5, wherein the lid further comprises channels, wherein the arms are configured to move, at least in part, within the channels.

7. The foldable container of claim 6, wherein the lid further comprises one or more collars extending across the channels.

8. The foldable container of claim 1 further comprising one or more partitions extending between the first walls or between the second walls.

* * * * *